US011339626B2

(12) United States Patent
Agrawal et al.

(10) Patent No.: US 11,339,626 B2
(45) Date of Patent: May 24, 2022

(54) SYSTEMS AND METHODS FOR MITIGATING AN UNCONTROLLED FLUID FLOW FROM A TARGET WELLBORE USING A RELIEF WELLBORE

(71) Applicant: BP CORPORATION NORTH AMERICA INC., Houston, TX (US)

(72) Inventors: Madhusuden Agrawal, Katy, TX (US); Paulo Jorge Da Cunha Gomes, Richmond (GB); James H. Knight, Cypress, TX (US); Satpreet Nanda, Katy, TX (US); Lei Zhou, Katy, TX (US); Eugene Sweeney, Houston, TX (US)

(73) Assignee: BP Corporation North America Inc., Houston, TX (US)

( * ) Notice: Subject to any disclaimer, the term of this patent is extended or adjusted under 35 U.S.C. 154(b) by 188 days.

(21) Appl. No.: 16/630,409

(22) PCT Filed: Jul. 13, 2018

(86) PCT No.: PCT/US2018/042012
§ 371 (c)(1),
(2) Date: Jan. 10, 2020

(87) PCT Pub. No.: WO2019/014548
PCT Pub. Date: Jan. 17, 2019

(65) Prior Publication Data

US 2020/0141208 A1 May 7, 2020

Related U.S. Application Data

(60) Provisional application No. 62/532,741, filed on Jul. 14, 2017.

(51) Int. Cl.
*E21B 33/13* (2006.01)
*E21B 41/00* (2006.01)
(Continued)

(52) U.S. Cl.
CPC ..... *E21B 33/13* (2013.01); *E21B 7/04* (2013.01); *E21B 41/0092* (2013.01); *E21B 47/00* (2013.01)

(58) Field of Classification Search
CPC . E21B 41/00; E21B 7/18; E21B 33/13; E21B 41/0092; E21B 47/00; E21B 7/04
See application file for complete search history.

(56) References Cited

U.S. PATENT DOCUMENTS 5,230,387 A 7/1993 Waters et al.
10,018,004 B2 7/2018 Abrant et al.
(Continued)

FOREIGN PATENT DOCUMENTS

WO 2015/010034 A1 1/2015
WO 2016/039755 A1 3/2016
(Continued)

OTHER PUBLICATIONS

Vallejo-Arrieta, Victor Garardo, "Analytical Model to Control Off-Bottom Blowouts Utilizing the Concept of Simultaneous Dynamic Seal and Bullheading," LSU Doctoral Dissertations, 2002 (224 p.).
(Continued)

*Primary Examiner* — Daniel P Stephenson
(74) *Attorney, Agent, or Firm* — Conley Rose, P.C.

(57) ABSTRACT

A method for mitigating a fluid flow from a target wellbore using a relief wellbore includes receiving wellbore geometry information of the target wellbore, receiving an initial interception point of the target wellbore, simulating a change in a three-dimensional flow characteristic of a kill fluid flow from a simulated relief wellbore and a target fluid flow from a simulated target wellbore resulting from an interaction between the kill fluid flow and the target fluid flow at the initial interception point, the simulated target wellbore designed using the received wellbore geometry information,
(Continued)

and determining a final interception point of the target wellbore based on the simulation.

30 Claims, 19 Drawing Sheets

(51) Int. Cl.
*E21B 47/00* (2012.01)
*E21B 7/04* (2006.01)

(56) References Cited

U.S. PATENT DOCUMENTS

| | | | | |
|---|---|---|---|---|
| 2014/0174740 | A1* | 6/2014 | Parlin | E21B 7/061 166/292 |
| 2015/0021029 | A1* | 1/2015 | Abrant | E21B 29/02 166/298 |
| 2016/0115743 | A1 | 4/2016 | Reedy | |
| 2017/0218719 | A1* | 8/2017 | Lugo | E21B 33/064 |
| 2017/0248006 | A1* | 8/2017 | Hess | E21B 47/022 |
| 2020/0141208 | A1* | 5/2020 | Agrawal | E21B 47/00 |

FOREIGN PATENT DOCUMENTS

| | | | |
|---|---|---|---|
| WO | 2016/057014 | A1 | 4/2016 |
| WO | 2017/003487 | A1 | 1/2017 |

OTHER PUBLICATIONS

Blotto, Paola et al., "Software Simulation and System Design of Dynamic Killing Technique," Society of Petroleum Engineers Annual Technical Conference and Exhibition, Sep. 26-29, 2004, Houston, Texas (SPE-90427-MS) (3 p.).

Abel, L.W. et al., "Comparison of Steady State and Transient Analysis Dynamic Kill Models for Prediction of Pumping Requirements," Society of Petroleum Engineers SPE/IADC Drilling Conference, Mar. 12-15, 1996, New Orleans, Louisiana (SPE-35120-MS) (2 p.).

Smestad, Paul et al., "Part 5-Hydraulics Modeling; Matching Known Downhole Well Information with Surface Flow Characteristics of a Blowout Via Computer Allows Selection of the Most Efficient Kill Method," John Wright Co. (7 p.).

Flores-Avila, Fernando S. et al., "New Dynamic Kill Procedure for Off-Bottom Blowout Wells Considering Counter-Current Flow of Kill Fluid," Society of Petroleum Engineers SPE/IADC Middle East Drilling Technology Conference and Exhibition, Oct. 20-22, 2003, UAE (SPE-85292-MS) (3 p.).

Bybee, Karen," Well Intervention and Control: Dynamic-Kill Procedure Considers Countercurrent Flow of Kill Fluid," Society of Petroleum Engineers, Journal of Petroleum Technology, vol. 56, No. 1, Jan. 2004 (SPE-0104-0053-JPT) (2 p.).

Upchurch, Eric R. et al., "Blowout Prevention and Relief Well Planning for the Wheatstone Big-Bore Gas Well Project," Society of Petroleum Engineers Annual Technical Conference and Exhibition, Sep. 28-30, 2015, Houston, Texas (SPE-174890-MS) (4 p.).

Noynaert, Samuel F. et al., "Modeling Ultra-Deepwater Blowouts and Dynamic Kills and the Resulting Blowout Control Best Practices Recommendations," Society of Petroleum Engineers SPE/IADC Drilling Conference, Feb. 23-25, 2005, Amsterdam, Netherlands (SPE-92626-MS) (3 p.).

Yuan, Zhaoguang et al, "Ultra-Deepwater Blowout Well Control Analysis Under Worst Case Blowout Scenario," Journal of Natural Gas Science and Engineering, vol. 27, No. 1, Nov. 2015, pp. 122-129 (2 p.).

Oudeman, Pieter et al., "Modelling Blowout Control by Means of Downhole Kill Fluid Injection," Society of Petroleum Engineers Offshore Europe, Sep. 7-10, 1993, Aberdeen, United Kingdom (SPE-26732-MS) (2 p.).

PCT/US2018/042012 International Search Report and Written Opinion dated Mar. 6, 2019 (23 p.).

Rygg O.B. et al., "Dynamic Two-Phase Flow Simulator: A Powerful Tool for Blowout and Relief Well Kill Analysis," Society of Petroleum Engineers (SPE 24578), Washington, DC, Oct. 4-7, 1992 (12 p.).

International Search Report and Written Opinion dated Mar. 6, 2019, for Application No. PCT/US2018/042012 (see page 16 for document citation).

* cited by examiner

SYSTEMS AND METHODS FOR MITIGATING AN UNCONTROLLED FLUID FLOW FROM A TARGET WELLBORE USING A RELIEF WELLBORE

CROSS-REFERENCE TO RELATED APPLICATIONS

This application is a 35 U.S.C. § 371 national stage application of PCT/US2018/042012 filed Jul. 13, 2018 and entitled "Systems and Methods for Mitigating an Uncontrolled Fluid Flow from a Target Wellbore Using a Relief Wellbore," which claims benefit of U.S. provisional patent application Ser. No. 62/532,741 filed Jul. 14, 2017, and entitled "Systems and Methods for Drilling Relief Wells, each of which is hereby incorporated herein by reference in its entirety for all purposes.

STATEMENT REGARDING FEDERALLY SPONSORED RESEARCH OR DEVELOPMENT

Not applicable.

BACKGROUND

Embodiments disclosed herein generally relate to wellbore designs and drilling operations. More particularly, embodiments disclosed herein relate to systems and methods for designing and drilling relief wells or wellbores intended to intercept target wells or wellbores, as well as methods for terminating uncontrolled fluid flows or "blowouts" in target wellbores using the drilled relief wellbores.

Wellbores are drilled into subterranean earthen formations to facilitate the recovery of hydrocarbons from reservoirs within the subterranean formation. During drilling operations, a rapid, uncontrolled influx of formation fluids may enter the wellbore, a condition sometimes referred to as a "blowout." In the event of a blowout, efforts are undertaken to cease the influx of formation fluids to surface. Thus, in some cases, a relief wellbore is drilled in proximity to the blown out or target wellbore, with the relief wellbore intercepting the target wellbore at a location above the location where the formation fluids are entering the target wellbore. Once the relief wellbore is drilled, a fluid, sometimes referred to as "kill fluid," is pumped from the surface through the relief wellbore and into the target wellbore to apply sufficient hydraulic pressure against the influx of formation fluids into the target wellbore and thereby terminate or "kill" the influx of formation fluids into the target wellbore.

SUMMARY

An embodiment of a method for mitigating a fluid flow from a target wellbore using a relief wellbore comprises receiving wellbore geometry information of the target wellbore, receiving an initial interception point of the target wellbore, simulating a change in a three-dimensional flow characteristic of a kill fluid flow from a simulated relief wellbore and a target fluid flow from a simulated target wellbore resulting from an interaction between the kill fluid flow and the target fluid flow at the initial interception point, the simulated target wellbore designed using the received wellbore geometry information, and determining a final interception point of the target wellbore based on the simulation. In some embodiments, the method further comprises drilling the relief wellbore to intercept the target wellbore at the final interception point. In some embodiments, the method further comprises extending a tubular string through the relief wellbore, and pumping the kill fluid flow through the tubular string and into the target wellbore at the final interception point. In certain embodiments, the method further comprises providing a first increased velocity of the kill fluid flow as the kill fluid flow exits the tubular string. In certain embodiments, the method further comprises providing a second increased velocity of the kill fluid as the kill fluid exits the tubular string that is different from the first increased velocity. In some embodiments, the method further comprises pumping the kill fluid flow from the relief wellbore into and through the target wellbore to a location downhole of the final interception point. In some embodiments, determining at least one parameter of the kill fluid flow of the relief wellbore based on the simulation comprises determining at least one of a desired kill fluid flow rate and a desired kill fluid density of the kill fluid flow. In certain embodiments, the method further comprises simulating three-dimensional vector effects of the kill fluid flow from the simulated relief wellbore at the initial interception point. In certain embodiments, the method further comprises receiving formation information pertaining to a subterranean formation through which the target wellbore extends, the formation information comprising a fracture gradient of the formation, and determining a desired kill fluid flow rate and a desired kill fluid density of the relief wellbore based on the simulation, the desired kill fluid flow rate and the desired kill fluid density configured to provide a pressure at the formation that does not exceed the fracture gradient of the formation at the final interception point. In some embodiments, the method further comprises determining an intercept angle between the relief wellbore and the target wellbore at the final interception point based on the simulation.

An embodiment of a method for mitigating a fluid flow from a target wellbore using a relief wellbore comprises receiving wellbore geometry information of the target wellbore, simulating three-dimensional vector effects of a kill fluid flow from a simulated relief wellbore into a simulated target wellbore, the simulated target wellbore designed using the received wellbore geometry information, and drilling the relief wellbore to intercept the target wellbore. In some embodiments, the method further comprises flowing a kill fluid flow from the relief wellbore into the target wellbore, at least one of the fluid density and fluid flow rate of the kill fluid flow selected using the simulated three-dimensional vector effects. In some embodiments, the method further comprises simulating a trajectory of the kill fluid flow as the kill fluid flow enters and flows through the target wellbore. In certain embodiments, the method further comprises simulating a jetting effect applied to the kill fluid flow. In certain embodiments, the method further comprises jetting the kill fluid flow from a nozzle disposed proximal a terminal end of the relief wellbore, a diameter of the nozzle selected using the simulated jetting effect. In some embodiments, the method further comprises simulating a first trajectory of the kill fluid flow as the kill fluid flow exits a simulated nozzle. In some embodiments, the method further comprises adjusting a jetting angle of the simulated nozzle, and simulating a trajectory of the kill fluid flow as the relief flow exits the simulated nozzle. In certain embodiments, the method further comprises simulating three-dimensional vector effects of a target fluid flow from a simulated target wellbore. In certain embodiments, the method further comprises simulating a change in a three-dimensional flow characteristic of the kill fluid flow from the simulated relief wellbore and a target fluid flow from the simulated target wellbore resulting from an interaction between the kill fluid flow and the target fluid flow at the initial interception point. In certain embodiments, the method further comprises receiving an initial interception point of the target wellbore, and determining a final interception point of the target wellbore based on the simulation.

An embodiment of a well system comprises a target wellbore comprising a target fluid flow, and a relief wellbore that intercepts the target wellbore at a final interception point, the relief wellbore including a kill fluid flow configured to cease the target fluid flow, wherein the relief wellbore is designed using a well simulation system executed by a computer system, the well simulation system configured to simulate three-dimensional vector effects of a kill fluid flow from a simulated relief wellbore into a simulated target wellbore. In some embodiments, the well simulation system comprises a processor, and a memory coupled to the processor, the memory encoded with instructions that are executable by the computer to receive wellbore geometry information of the target wellbore, and generate one or more parameters of the relief wellbore, the relief wellbore parameters comprising at least one of the interception point of the relief wellbore in true vertical depth, a fluid density of the kill fluid flow, and a fluid flow rate of the kill fluid flow. In some embodiments, the memory of the well simulation system is encoded with instructions that are executable by the computer to simulate a change in a three-dimensional flow characteristic of the simulated kill fluid flow and a simulated target fluid flow from the simulated target wellbore resulting from an interaction between the simulated kill fluid flow and the simulated target fluid flow at the interception point of the simulated relief and target wellbores. In certain embodiments, the memory of the well simulation system is encoded with instructions that are executable by the computer to generate one or more parameters of a tubular string insertable into the relief wellbore, the tubular string parameters comprising a diameter of a nozzle of the tubular string. In certain embodiments, the three-dimensional vector effects simulated by the well simulation system comprise at least one of simulated three-dimensional force and velocity vectors.

An embodiment of a method for mitigating a fluid flow from a target wellbore using a relief wellbore comprises inserting a tubular string into the relief wellbore, positioning a first jetting tool coupled to an end of the tubular string adjacent an interception point between the relief wellbore and the target wellbore, flowing a kill fluid through the tubular string to the first jetting tool, and jetting the kill fluid through a nozzle of the first jetting tool and into the target wellbore at a first jetting angle. In some embodiments, the method further comprises rotating the tubular string in the relief wellbore, and jetting the kill fluid through the nozzle of the first jetting tool and into the target wellbore at a second jetting angle that is different from the first jetting angle. In some embodiments, the method further comprises coupling a second jetting tool to the tubular string including a nozzle configured to provide a second jetting angle that is different from the first jetting angle, and jetting the kill fluid through the nozzle of the second jetting tool and into the target wellbore at the second jetting angle. In certain embodiments, the nozzle of the first jetting tool includes a first flow restriction configured to increase the velocity of the kill fluid as it is jetted through the nozzle of the first jetting tool. In certain embodiments, the method further comprises coupling a second jetting tool to the tubular string including a nozzle having a second flow restriction that is greater than the first flow restriction of the first jetting tool, and jetting the kill fluid through the nozzle of the second jetting tool and into the target wellbore.

Embodiments described herein comprise a combination of features and characteristics intended to address various shortcomings associated with certain prior devices, systems, and methods. The foregoing has outlined rather broadly the features and technical characteristics of the disclosed embodiments in order that the detailed description that follows may be better understood. The various characteristics and features described above, as well as others, will be readily apparent to those skilled in the art upon reading the following detailed description, and by referring to the accompanying drawings. It should be appreciated that the conception and the specific embodiments disclosed may be readily utilized as a basis for modifying or designing other structures for carrying out the same purposes as the disclosed embodiments. It should also be realized that such equivalent constructions do not depart from the spirit and scope of the principles disclosed herein.

BRIEF DESCRIPTION OF THE DRAWINGS

For a detailed description of various exemplary embodiments, reference will now be made to the accompanying drawings in which.

DETAILED DESCRIPTION

Figure 1:
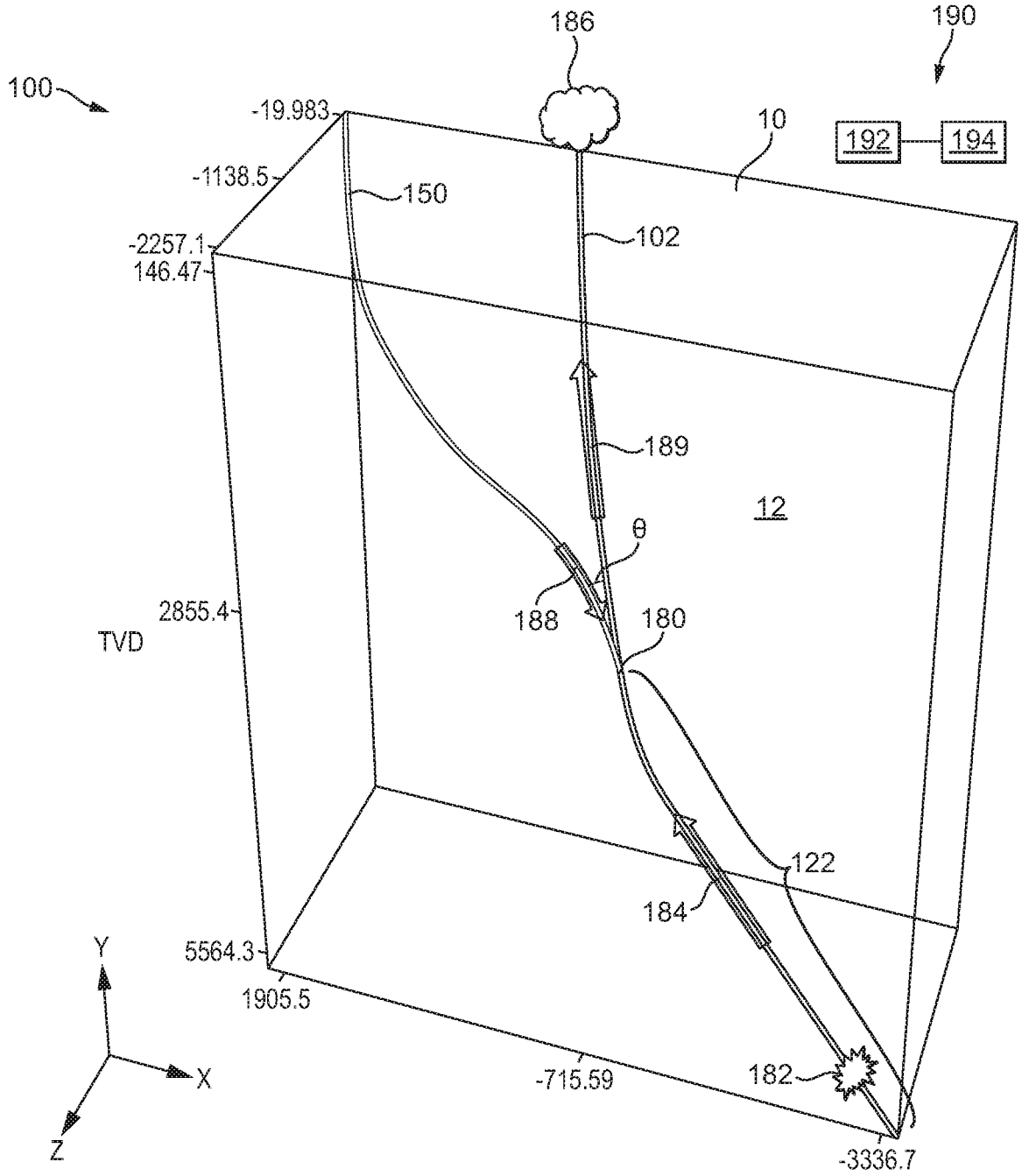
FIG. 1 is a three-dimensional schematic view of an embodiment of a well system in accordance with principles disclosed herein.

The following discussion is directed to various exemplary embodiments. However, one of ordinary skill in the art will understand that the examples disclosed herein have broad application, and that the discussion of any embodiment is meant only to be exemplary of that embodiment, and not intended to suggest that the scope of the disclosure, including the claims, is limited to that embodiment.

The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection of the two devices, or through an indirect connection that is established via other devices, components, nodes, and connections. In addition, as used herein, the terms "axial" and "axially" generally mean along or parallel to a given axis (e.g., central axis of a body or a port), while the terms "radial" and "radially" generally mean perpendicular to the given axis. For instance, an axial distance refers to a distance measured along or parallel to the axis, and a radial distance means a distance measured perpendicular to the axis.

Figure 2:
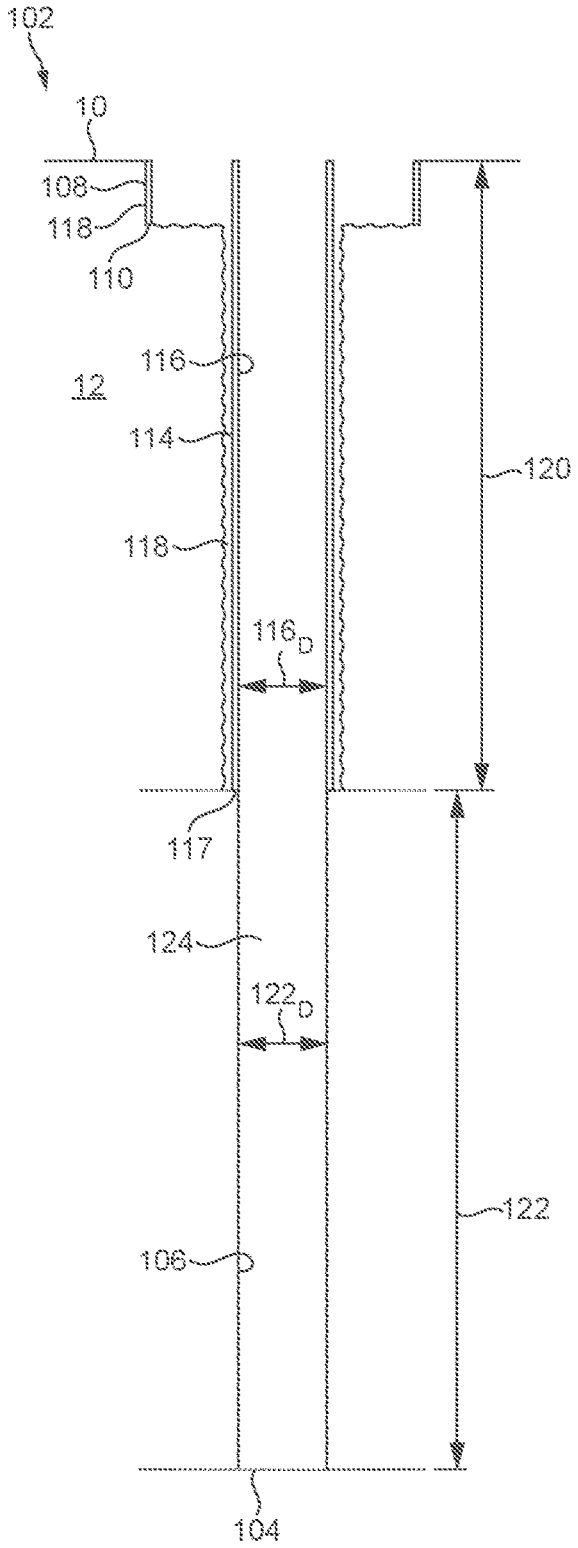
FIG. 2 is an enlarged schematic view of the target wellbore of FIG. 1.
Figure 3:
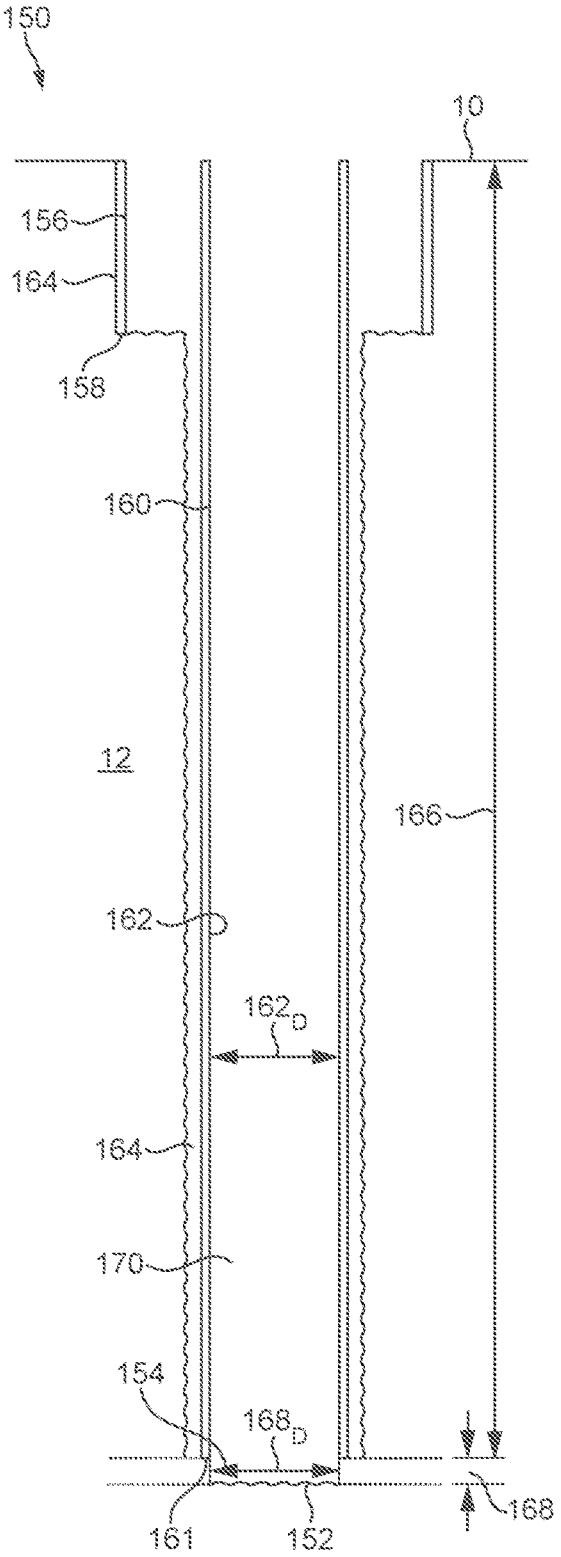
FIG. 3 is an enlarged schematic view of the relief wellbore of FIG. 1.

Referring now to FIGS. 1-3, an embodiment of a well system 100 is shown. In the embodiment of FIGS. 1-3, well system 100 includes a target well or wellbore 102 and a relief well or wellbore 150. Wellbores 102, 150 each extend from a surface 10 (extending along the X and Z axes shown in FIG. 1) into a subterranean earthen formation 12. As best shown in FIG. 2, target wellbore 102 includes a lower terminal end or bottom 104 opposite the surface 10, a generally cylindrical inner surface 106 formed in the subterranean formation 12, a first or upper casing string 108, and a second or lower casing string 114. Upper casing string 108 extends from the surface 10 to a lower terminal end or casing shoe 110. In some embodiments, upper casing string 108 may comprise a conductor casing 108 of target wellbore 102. Lower casing string 114 is disposed at least partially within upper casing 108 and extends to a lower terminal end or casing shoe 117, which is located at a greater depth relative to the surface 10 than the lower end 110 of upper casing string 108.

Cement 118 is positioned between an outer cylindrical surface of each casing string 108, 114 and the inner surface 106 of target wellbore 102. Cement 118 seals the annular interfaces between the outer surfaces of casing strings 108, 114 and inner surface 106 of target wellbore 102. In this arrangement, target wellbore 102 comprises a cased portion 120 extending from the surface 10 to the casing shoe 117 of lower casing 114, and an uncased or "openhole" portion 122 extending from casing shoe 117 to the bottom 104 of target wellbore 102. A central passage 124 is formed in target wellbore 102 defined by the inner surface 106 of openhole portion 122 and a cylindrical inner surface 116 of lower casing 114. The inner surface 106 of the cased portion 120 of target wellbore 102 is sealed or isolated from pressure in central passage 124 while the inner surface of openhole portion 122 is exposed to pressure in central passage 124.

In the exemplary embodiment of FIGS. 1-3, cased portion 120 of target wellbore 102 extends approximately 3,790 feet (ft) from surface 10 while openhole portion 122 of wellbore 102 extends approximately 3,710 ft with bottom 104 of target wellbore 102 positioned approximately 7,500 ft from surface 10 (approximately 5,560 ft in true vertical depth (TVD)). Additionally, in the embodiment of FIGS. 1-3, the diameter $\mathbf{116}_D$ of the inner surface 116 of lower casing 114 is approximately 13⅝" while the inner surface 106 of openhole portion 168 has a diameter $\mathbf{168}_D$ of approximately 12¼". However, in other embodiments, the geometry (e.g., depths, diameters, etc.) of target wellbore 102 may vary significantly.

As best shown in FIG. 3, relief wellbore 150 includes a lower end 152 opposite the surface 10, a generally cylindrical inner surface 154 formed in the subterranean formation 12, a first or upper casing string 156, and a second or lower casing string 160. Upper casing string 156 extends from the surface 10 to a lower terminal end or casing shoe 158. In some embodiments, upper casing string 156 may comprise a conductor casing 156 of relief wellbore 150. Lower casing string 160 is disposed at least partially within upper casing 156 and extends to a lower terminal end or casing shoe 161, casing shoe 161 being located at a greater depth from surface 10 than the lower end 158 of upper casing string 156.

Cement 164 is positioned between an outer cylindrical surface of each casing string 156 and 160 and the inner surface 154 of relief wellbore 150. Cement 164 seals the annular interfaces formed between the outer surfaces of casing strings 156 and 160 and inner surface 154 of relief wellbore 150. In this arrangement, relief wellbore 150 comprises a cased portion 166 extending from the surface 10 to the casing shoe 161 of lower casing 160, and an uncased or "openhole" portion 168 extending from the casing shoe 161 to the lower end 152 of relief wellbore 150. A central passage 170 is formed in relief wellbore 150 defined by the inner surface 154 of openhole portion 168 and a cylindrical inner surface 162 of lower casing 160. The inner surface 154 of the cased portion 166 of relief wellbore 150 is sealed or isolated from pressure in central passage 170 while the inner surface of openhole portion 168 is exposed to pressure in central passage 170.

In the exemplary embodiment of FIGS. 1-3, cased portion 166 of relief wellbore 150 extends approximately 4,900 feet (ft) from surface 10 while openhole portion 168 of wellbore 150 extends approximately 100 ft with lower end 152 of relief wellbore 150 positioned approximately 5,000 ft from surface 10 (approximately 2,850 ft TVD). Additionally, in the embodiment of FIGS. 1-3, the diameter $\mathbf{162}_D$ of the inner surface 162 of lower casing 160 is approximately 13⅝" while the inner surface 154 of openhole portion 168 has a diameter $\mathbf{168}_D$ of approximately 12¼". However, in other embodiments, the geometry (e.g., depths, diameters, etc.) of relief wellbore 150 may vary significantly.

Referring again to FIG. 1, the lower end 152 of relief wellbore 150 intercepts target wellbore 102 at an interception or interception point 180, where fluid communication is provided between central passage 124 of target wellbore 102 and central passage 170 of relief wellbore 150. In this embodiment, interception point 180 is formed between the lower end 152 of relief wellbore 150 and the openhole portion 122 of target wellbore 102 at approximately 2,850 ft TVD; however, in other embodiments, the positioning of interception point 180 along target wellbore 102 and relative surface 10 may vary substantially. Particularly, interception point 180 is located at the casing shoe 117 of lower casing string 114. The lower end 152 of relief wellbore 150 intercepts target wellbore 102 at an angle of intercept or intercept angle θ. In some embodiments, intercept angle θ may be approximately between about 5 degrees to about 10 degrees.

In the embodiment of FIGS. 1-3, target wellbore 102 is generally designed to produce gaseous hydrocarbons from the formation 12. In some applications, as target wellbore 102 is drilled into formation 12, wellbore 102 may experience a formation kick or a rapid, uncontrolled influx 182 of fluid (shown in FIG. 1) from formation 12 into target wellbore 102. The uncontrolled influx 182, having entered target wellbore 102, flows upwards through central passage 124 of target wellbore 102 as an uncontrolled or blowout fluid flow 184, and is ejected from target wellbore 102 at the surface 10 as a fluid blowout 186. In the embodiment of FIGS. 1-3, blowout fluid flow 184 is substantially gaseous; however, in other embodiments, the content of blowout fluid flow 184 may vary substantially.

In some situations, the blowout fluid flow 184 may not be controllable at the surface 10 by closing one or more blowout preventers (BOP) positioned at the surface 10. In such situations, relief wellbore 150 of well system 100 can be used to provide a relief or kill fluid flow 188 to target wellbore 102 above the location of uncontrolled influx 182 to stabilize or control the blowout fluid flow 184. In particular, kill fluid flow 188 is delivered to target wellbore 102 at the interception point 180 and is designed to substantially decrease or cease the flow rate of blowout fluid flow 184. In other words, the kill fluid flow 188 delivered by relief wellbore 150 to target wellbore 102 is designed to substantially decrease or cease the influx 182 of fluids from formation 12 into target wellbore 102.

Referring still to FIG. 1, well system 100 includes a well simulation system 190. As will be described in more detail below, well simulation system 190 is used to facilitate the design and configuration of relief wellbore 150. Additionally, well simulation system 190 is used to assist in determining one or more parameters of the kill fluid flow 188 of relief wellbore 150. Although well simulation system 190 is shown proximal the target and relief wellbores 102, 150 of well system 100, in other embodiments, well simulation system 190 may be located distal wellbores 102, 150. Additionally, in some embodiments, well simulation system 190 may be used in conjunction with a plurality of well systems, with each well system varying substantially in configuration.

In this embodiment, well simulation system 190 includes a processor 192 and a memory 194 coupled to the processor 192. The memory 194 is encoded with instructions that are executable by a computer to (a) receive wellbore geometry information of a target wellbore (e.g., target wellbore 102), (b) simulate three-dimensional vector effects of a kill fluid flow from a simulated relief wellbore into a simulated target wellbore the simulated target wellbore designed using the received wellbore geometry information, and (c) generate one or more parameters of a relief wellbore (e.g., relief wellbore 150) to stabilize the target wellbore by ceasing flow from a subterranean formation (e.g., influx 182 from formation 12) into the target wellbore. The relief wellbore parameters include, without limitation, at least one of an interception point (e.g., interception point 180) of the relief wellbore with the target wellbore in true vertical depth, a fluid density of a relief wellbore fluid (e.g., the fluid comprising kill fluid flow 188), and a fluid flow rate of a relief wellbore fluid. In some embodiments, the memory is encoded with instructions executable by the computer to simulate a change in the three-dimensional flow characteristics in the simulated kill fluid flow and a simulated target fluid flow from the simulated target wellbore resulting from an interaction between the simulated kill fluid flow and the simulated target fluid flow at the interception point. The three-dimensional flow characteristics simulated by the computer may include fluid momentum, density, mass, velocity, counter-flow or "slip" between the simulated relief and target fluid flows, as well as other fluid flow characteristics. In certain embodiments, the memory is encoded with instructions executable by the computer to generate one or more parameters of a relief string insertable into the relief wellbore, the relief string parameters comprising a diameter of a nozzle of the relief string, as will be discussed further herein. In still further embodiments, the simulated three-dimensional vector effects comprise at least one of simulated three-dimensional force and velocity vectors.

Figure 4:
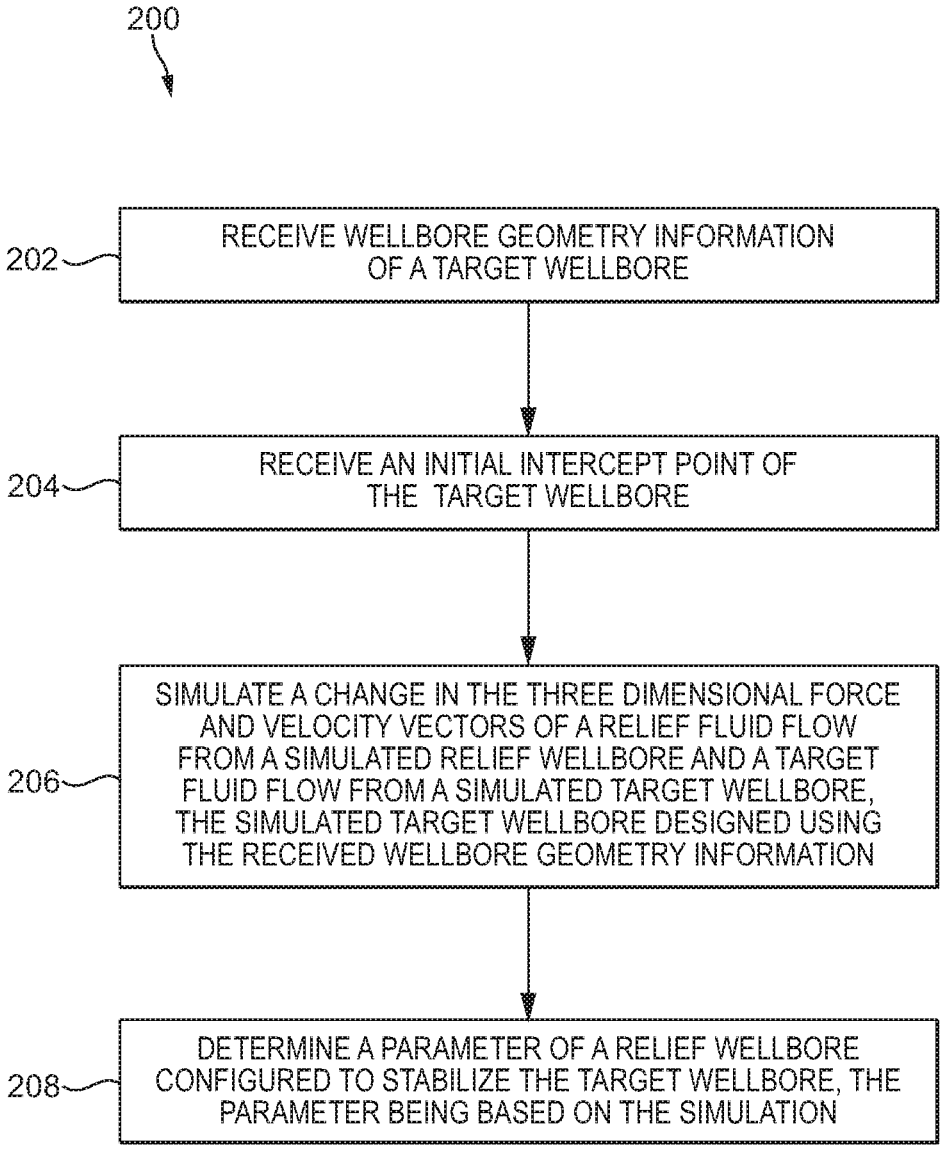
FIG. 4 is a flowchart illustrating an embodiment of a method for mitigating a fluid flow from a target wellbore using the relief wellbore of FIG. 3 in accordance with principles disclosed herein.

Referring now to FIG. 4, an embodiment of a method 200 for mitigating a fluid flow from a target wellbore using a relief wellbore, such as the relief wellbore 150 of the embodiment of FIGS. 1-3, is shown. At block 202 of method 200, wellbore geometry information of a target wellbore is received. In some embodiments, block 202 comprises receiving information related to both the geometry of the target wellbore and the subterranean earthen formation through which the target wellbore extends. For instance, in some embodiments, block 202 comprises receiving information related to the formation 12 (FIGS. 1-3) including the types of materials comprising formation 12, the formation fluids (content, state, pressure, temperature, etc.) trapped within formation 12, and the pore pressure and fracture gradient profiles of formation 12. In certain embodiments, block 202 comprises receiving the trajectory of the target wellbore, such as the trajectory of the target wellbore 102 (FIGS. 1-3).

In certain embodiments, block 202 of method 200 comprises receiving information related to the design or construction of the target wellbore, such as the sizing, length, etc., of various sections of the target wellbore and sizing, length, placement, existence of cementing, etc. of equipment disposed in the target wellbore, such as casing or liner strings. Thus, in some embodiments, block 202 comprises receiving information related to the sizing, length, placement, materials of construction, etc., of the casing strings 108 and 114 of target wellbore 102. Additionally, in certain embodiments, block 202 comprises receiving information related to the size (e.g., inner diameter), length, and trajectory of the cased (in embodiments where the target wellbore includes a cased portion) and openhole portions of the target wellbore, such as the cased and openhole portions 120, 122 of the embodiment of target wellbore 102 of FIGS. 1-3.

At block 204 of method 200, an initial interception point of the target wellbore is received. In some embodiments, the initial interception point may comprise a location on the target wellbore at the casing shoe of a lowermost casing or liner string of the target wellbore. In certain embodiments, block 204 comprises receiving an initial interception or interception point for the target wellbore 102 (FIGS. 1-3), where interception point 180 comprises an initial interception point; however, in other embodiments, interception point 180 may comprise a final interception point that varies from the initial interception point.

At block 206 of method 200, a change in the three dimensional force and velocity vectors of a kill fluid flow from a simulated relief wellbore and a target fluid flow from a simulated target wellbore are simulated, the simulated target wellbore designed using the wellbore geometry information received at block 202 of method 200. In some embodiments, block 206 may comprise simulating a change in the three-dimensional flow characteristics in the kill fluid flow from the simulated relief wellbore and the target fluid flow from the target wellbore. In some embodiments, the three-dimensional flow characteristics simulated at block 206 include fluid momentum, density, mass, velocity, counter-flow or "slip" between the relief and target fluid flows. As will be discussed further herein, in some embodiments, block 206 of method 200 comprises using computational fluid dynamics (CFD) to construct a three-dimensional model of the interception point between the simulated target and relief wellbores, simulating a three-dimensional, multiphase fluid flow through the target wellbore past the interception point, and simulating a three-dimensional, multiphase fluid flow extending from the simulated relief wellbore, through the interception point, and into the simulated target wellbore. In some embodiments, the simulation of block 206 is performed using the well simulation system 190 of FIG. 3.

At block 208 of method 200, a parameter of a relief wellbore to stabilize the target wellbore by ceasing flow from a subterranean formation into the target wellbore is determined, the parameter being based on the simulation performed at block 206 of method 200. In some embodiments, the parameter may comprise at least one of an inner diameter of the relief wellbore (e.g., diameter 162D of the inner surface 162 of lower casing 160, and/or diameter $\mathbf{168}_D$ of the inner surface 106 of openhole portion 168), a fluid or volumetric flow rate of fluid flowing through the relief wellbore (e.g., a volumetric flow rate of kill fluid flow 188), a fluid density, composition, or other property of the fluid flowing through the relief wellbore, a velocity of fluid exiting the lower end of the relief wellbore and flowing into the target wellbore through the interception point, a trajectory of the relief wellbore through the subterranean formation, the position of the interception point along the length of the target wellbore (e.g., a position of interception point 180 along the length of target wellbore 102), and an angle of intercept or interception angle between the lower end of the relief wellbore and the target wellbore (e.g., intercept angle $\theta$).

Figure 5:
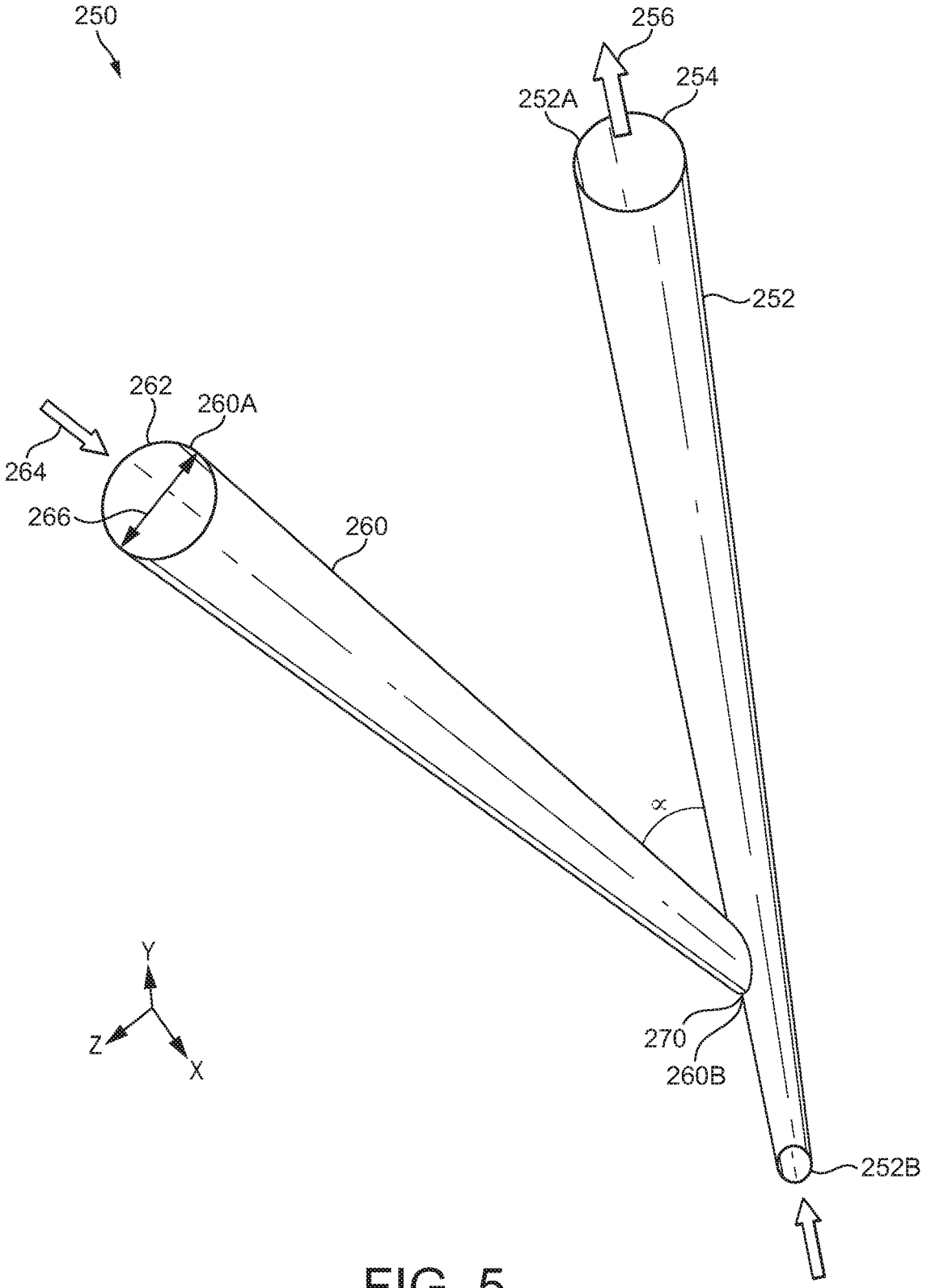
FIG. 5 is a perspective view of an embodiment of a three-dimensional model of an interception point between a simulated target wellbore and a simulated relief wellbore in accordance with principles disclosed herein.

Referring to FIGS. 1-6, a three-dimensional CFD model 250 of an interception point between a simulated target wellbore 252 and a simulated relief wellbore 260 is shown in FIG. 5. Model 250 is constructed using the well simulation system 190 of FIG. 1 and may be employed to perform the simulation of block 206 of the method 200 of FIG. 4. In the embodiment of FIGS. 1-6, simulations of fluid flow with model 250 are performed using STAR-CCM+ software produced by CD-Adapco™ of Melville, N.Y.; however, in other embodiments, other CFD software systems may be used for simulating fluid flows with model 250, such as Fluent and CFX provided by ANSYS, Inc. of Canonsburg, Pa., OpenFOAM®, SU2, OVERFLOW provided by the National Aeronautics and Space Administration (NASA) of Washington, D.C., Gerris, as well as other software systems known in the art. Simulated target wellbore 252 is simulates or models the portion of target wellbore 102 and blowout fluid flow 184 of FIGS. 1-3 at or proximal interception point 180 (shown as simulated interception or interception point 270 in FIG. 5). Following the simulations performed by model 250 of well simulation system 190, relief wellbore 150 of FIGS. 1-3 is drilled and kill fluid flow 188 is pumped therethrough in view of or based on the simulated relief wellbore 260. In other words, simulated target wellbore 252 is based or modeled on target wellbore 102 and blowout fluid flow 184, while relief wellbore 150 is constructed and operated in view of or based on simulated relief wellbore 260. Thus, model 250 and well simulation system 190 inform the construction and operation of the relief wellbore 150 of well system 100.

Simulated target wellbore 252 of model 250 includes an upper end or outlet 252A disposed above interception point 270, a lower end or inlet 252B disposed below interception point 270, and a central bore or passage 254 extending from inlet 252B to outlet 252A. Simulated relief wellbore 260 of model 250 includes an upper end or inlet 260A, a lower end or outlet 260B at interception point 270, and a central bore or passage 262 extending between inlet 260A and outlet 260B. Simulated relief wellbore 260 is disposed at a simulated angle of intercept or intercept angle $\alpha$. The central passage 254 of receives a simulated blowout fluid flow 256 modeled on blowout fluid flow 184 while the central passage 262 of simulated relief wellbore 260 receives a relief or kill fluid flow 264, as will be described further herein. Central passage 262 includes an inner diameter 266 that corresponds to the diameter $\mathbf{168}_D$ of the openhole portion 168 of relief wellbore 150.

As described above, simulated target wellbore 252 does not comprise a simulation or model of the entirety of target wellbore 102, but only the portion of target wellbore 102 disposed at or proximal to interception point 180 (or interception point 270 shown in FIG. 5). Similarly, simulated relief wellbore 260 only comprises the portion of the eventually created relief wellbore (e.g., relief wellbore 150) disposed at or proximal to interception point 180 (or interception point 270 shown in FIG. 5); however, in other embodiments, simulated wellbores 252 and 260 may comprise simulations or models of the entirety of target wellbore 102 and the eventually constructed relief wellbore (e.g., relief wellbore 150).

Figure 6:
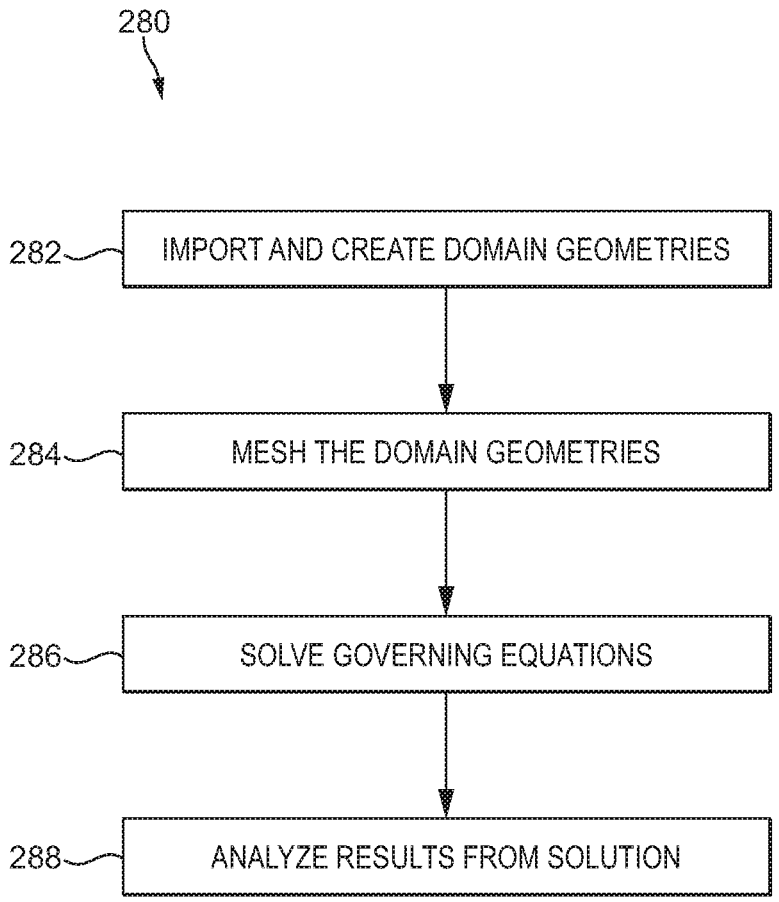
FIG. 6 is a flowchart illustrating an embodiment of a method for constructing the model of FIG. 5 and performing one or more simulations using the model in accordance with principles disclosed herein.

A method 280 of constructing model 250 of FIG. 5 and performing one or more simulations of fluid flow therewith is shown in FIG. 6. In some embodiments, method 280 of FIG. 6 may be performed in conjunction with method 200 of FIG. 4. For instance, in certain embodiments, block 206 of method 200 comprises the performance of method 280; however, in other embodiments, the performance of method 200 may not include performing any step of method 280, and the performance of method 280 may not include performing any step of method 200. In the embodiment of FIGS. 1-6, block 282 of model 280 includes importing and creating domain geometries of the three-dimensional model (e.g., model 250). In some embodiments, block 282 comprises performing the step described at block 202 of method 200—receiving wellbore geometry information of a target wellbore (e.g., target wellbore 102). For instance, in some embodiments block 282 comprises importing and creating the geometry of the portion of target wellbore 102 at or proximal to interception point 180, corresponding to the geometry of simulated target wellbore 252. Additionally, in certain embodiments, block 282 of method 280 comprises creating an initial geometry corresponding to the geometry of simulated relief wellbore 260. The initial geometry of simulated relief wellbore 260 may comprise an initial estimate of a geometry of simulated relief wellbore 260 sufficient to substantially decrease blowout fluid flow 256 in response to the flowing of kill fluid flow 264 into simulated target wellbore 252 at interception point 270. As will be discussed further herein, the initial geometry of simulated relief wellbore 260 (as well as parameters of kill fluid flow 264 may be updated or changed in view of the simulation performed by model 250).

At block 284 of method 200, the domain geometries created at block 282 are meshed. In some embodiments, block 284 comprises meshing or discretizing the geometries created at block 282 to allow for the accurate capture or portrayal of gradients or changes of various flow variables (e.g., pressure, velocity, temperature, phase volume fraction, etc.) in the modeled domain. At block 286 of method 200, equations governing the flow of fluid through the domain geometries meshed at block 286 are solved. In some embodiments, block 286 comprises selecting appropriate physics models for capturing the physics (e.g., fluid behavior) simulated by model 250. Selection of appropriate physics models may be made based on the accuracy desired by the simulation performed by model 250, where higher fidelity physics may provide more accurate simulations of fluid flow at the cost of additional required computing resources provided by the components (e.g., processor 192 and memory 194) of well simulation system 190.

In certain embodiments, block 286 comprises selecting physics models comprising non-newtonian rheology, physical properties of the relief and target fluid flows, compressibility of gas released from the subterranean formation into the target wellbore, turbulence models to capture effects of turbulent eddies in the relief and target fluid flows, as well as other properties. In some embodiments, the physics models may include Reynolds-averaged Navier-Stokes (RANS) turbulence models, and multiphase flow models to capture simultaneous flow of two or more immiscible interacting phases (e.g., kill mud of the kill fluid flow and gas released from the formation). In some embodiments, the multiphase flow models may comprise Eulerian or Volume of Fluid (VOF) models, depending upon the flow regime. For instance, Eulerian models may be used for target wellbores having bubbly flow regimes while VOF may be used for separated or slug flow regimes.

In certain embodiments, following the selection of the appropriate physics models for the particular application, the governing equations of the selected physics models are solved using well simulation system 190 to thereby simulate blowout fluid flow 256, kill fluid flow 264, and the interaction of fluid flows 256 and 264 at interception point 270 and within the central passage 254 of simulated target wellbore 252. Additionally, in some embodiments, block 286 comprises applying boundary conditions to the simulations performed at block 286 using one-dimensional, multiphase fluid models of the interception point 180 of well system 100. For instance, referring to FIGS. 1-8, a graph 290 illustrating a representative fluid velocity through a one-dimensional model of target wellbore 102 is shown in FIG. 7 and a graph 292 illustrating a representative mass flow rate through the one-dimensional model of target wellbore 102 is shown in FIG. 8.

Figure 7:
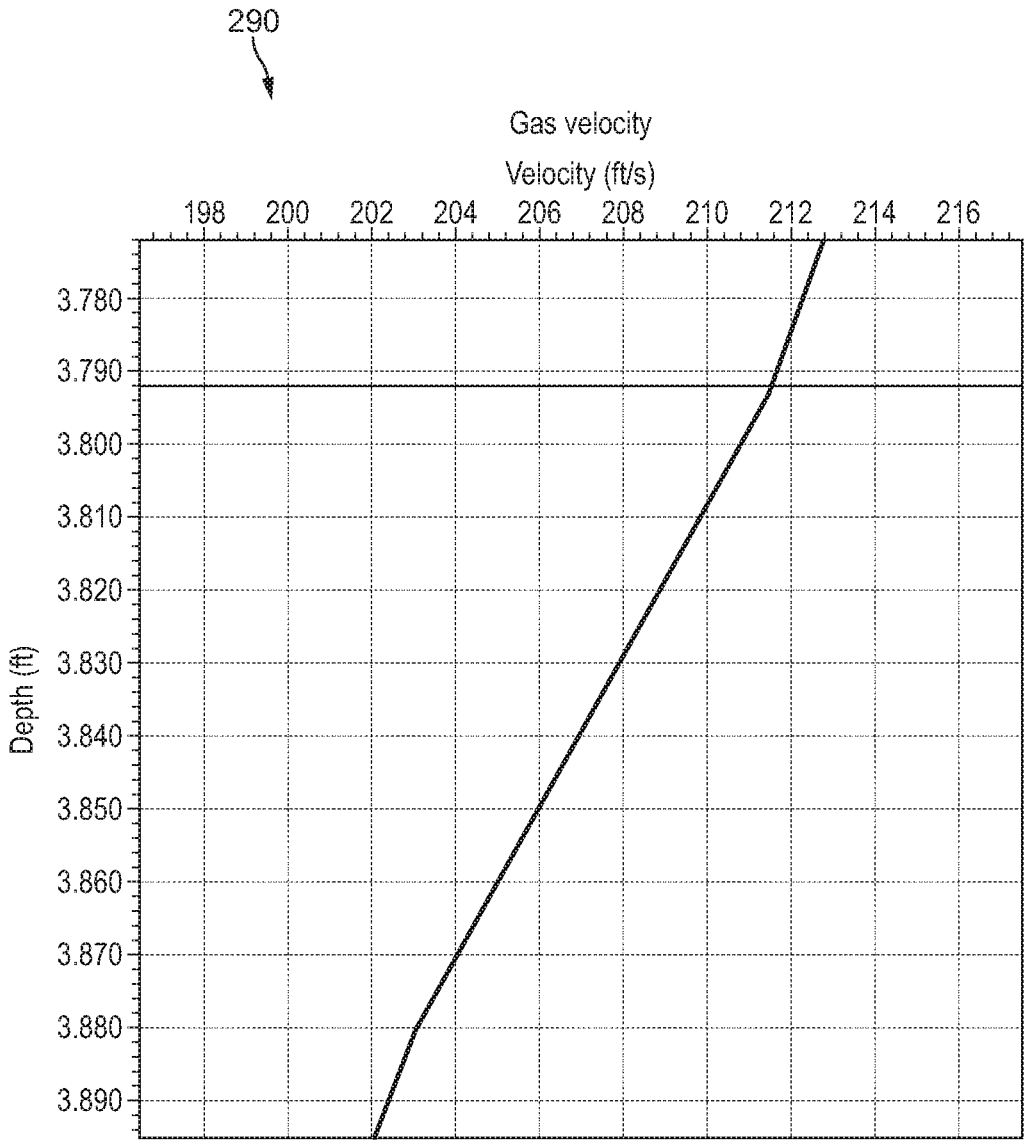
FIG. 7 is a graph illustrating a representative flow velocity in a simulated target wellbore of a one-dimensional fluid model in accordance with principles disclosed herein.
Figure 8:
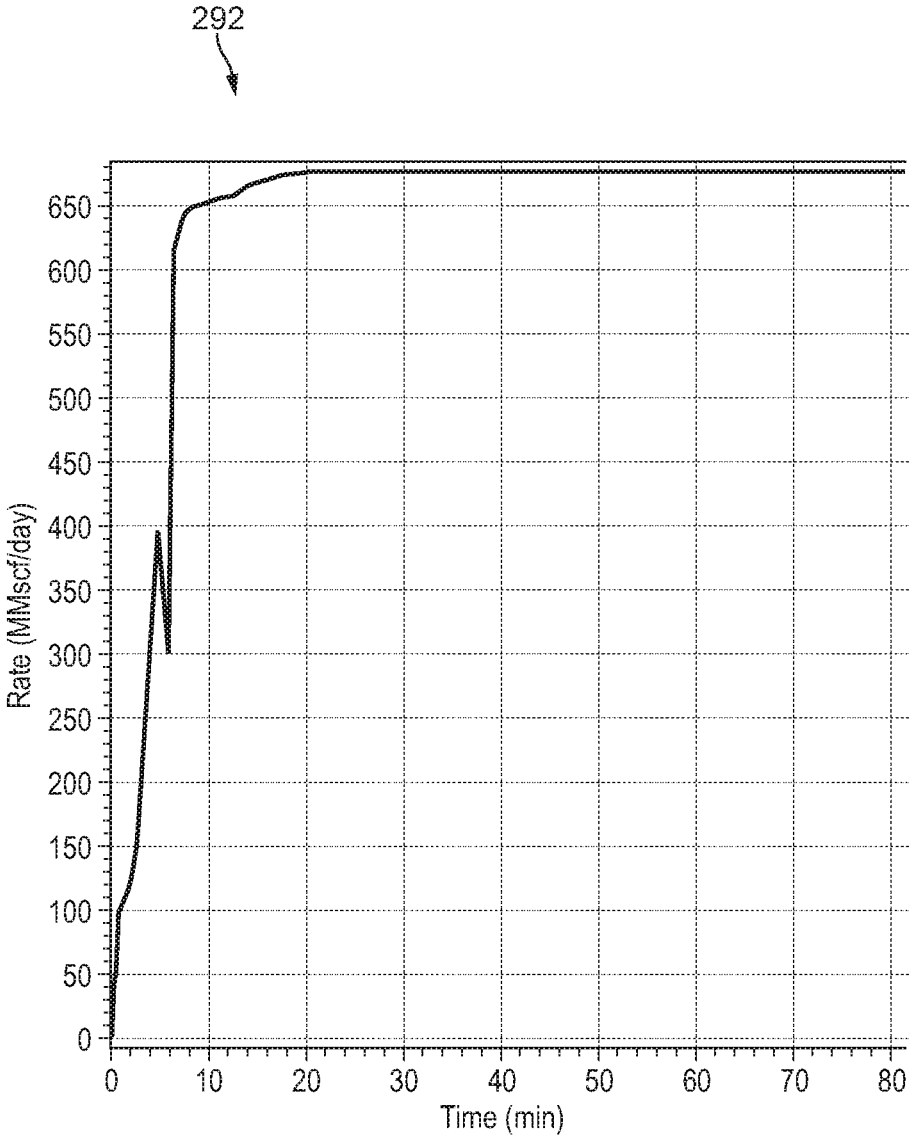
FIG. 8 is a graph illustrating a representative mass flow rate through the simulated target wellbore of FIG. 7.

In the embodiment of FIGS. 7 and 8, graphs 290 and 292 are produced by the OLGA™ multiphase flow simulator provided by Schlumberger Limited of Houston, Tex.; however, in other embodiments, other one-dimensional, multiphase flow simulators may be used to produce the velocity and mass flow rate graphs 290 and 292 of FIGS. 7 and 8. Graphs 290 and 292 of FIGS. 7 and 8 model or simulate (one dimensionally) a blowout fluid flow through a simulated target wellbore having a geometry corresponding to the geometry of target wellbore 102, where no drillstring or other equipment (besides the casing strings 108 and 114 shown in FIG. 2) is disposed in the simulated target wellbore. In this embodiment, the one-dimensional model indicates that the blowout fluid flow of the simulated target wellbore (e.g., simulated blowout fluid flow 184 of simulated target wellbore 102) at the interception point thereof has a fluid velocity of approximately 212 feet per second (ft/s), as shown in FIG. 7, and a mass flow rate of approximately 680 million standard cubic feet per day (MMSCF/day or MMSCF/d), as shown in FIG. 8; however, in other embodiments, the fluid composition, fluid velocity, and mass flow rate of the blowout fluid flow of the simulated target wellbore may vary substantially.

In the embodiment of FIGS. 7 and 8, graphs 290 and 292 are produced using a one-dimensional, three-fluid model that employs separate continuity equations for gas, hydrocarbons (oil, condensate, etc.), and water. In this embodiment, the one-dimensional model also employs three momentum equations—one equation for each of the two continuous liquid phases (hydrocarbons and water), and one equation for phases comprising gas with entrained liquid droplets. Velocity of entrained liquid droplets may be given by a slip relation. Following the application of one mixture energy equation, the one-dimensional model yields seven separate conservation equations and one equation of state to be solved—three conservation equations for mass, three equations for momentum, and one equation for energy. However, in this embodiment, the one-dimensional model employed to produce graphs 290 and 292 (as well as the boundary conditions used in block 286 of the embodiment of method 280 of FIG. 6) does not account for momentum changes between intersecting fluid flows, such as the intersection between a blowout fluid flow of a modeled or simulated target wellbore (e.g., modeled on target wellbore 102) and a relief or kill fluid flow of a modeled or simulated relief wellbore at the intersection point. Thus, although the one-dimensional model may provide boundary conditions for the method 280 of FIG. 6, it cannot model the interaction of fluid flows between modeled or simulated relief and target wellbores with the same accuracy, reliability, and precision as the three-dimensional model 250 of the embodiment of FIG. 5 constructed and operated using the method 280 of the embodiment of FIG. 6.

Figure 9:
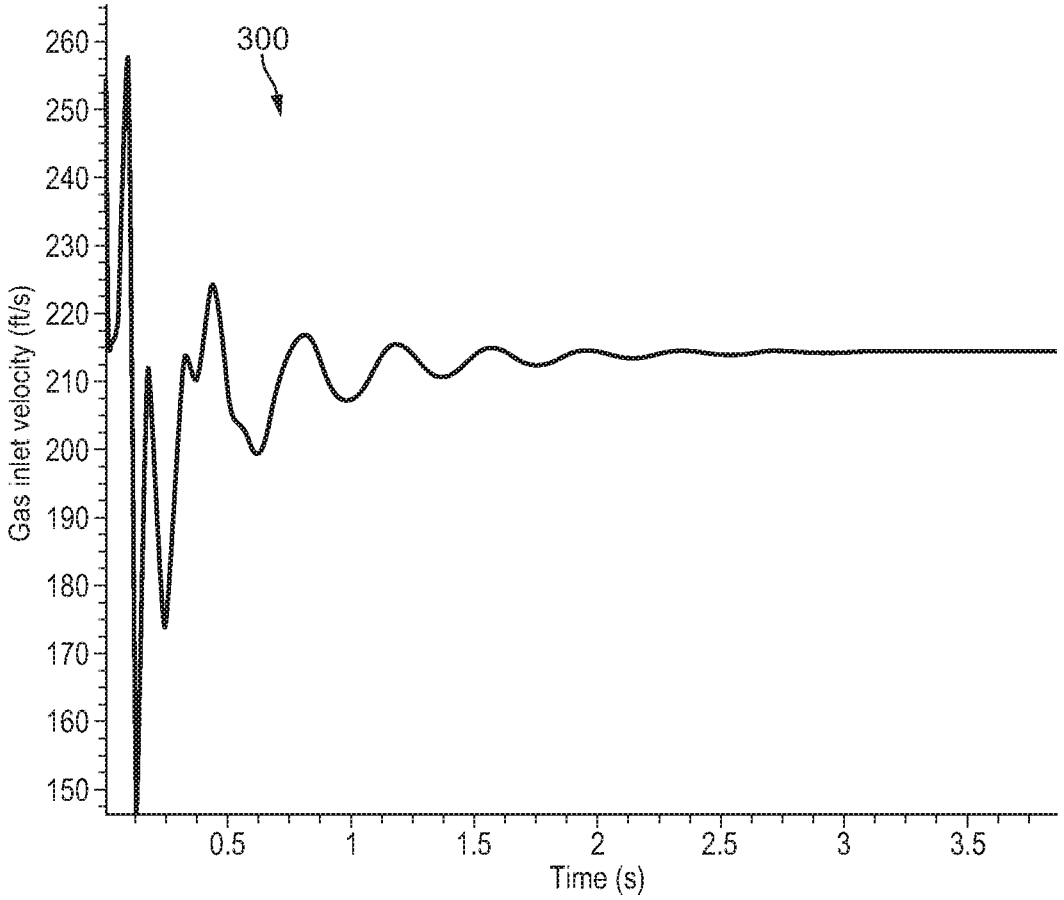
FIG. 9 is a graph illustrating a representative flow velocity in the simulated target wellbore of FIG. 5.
Figure 10:
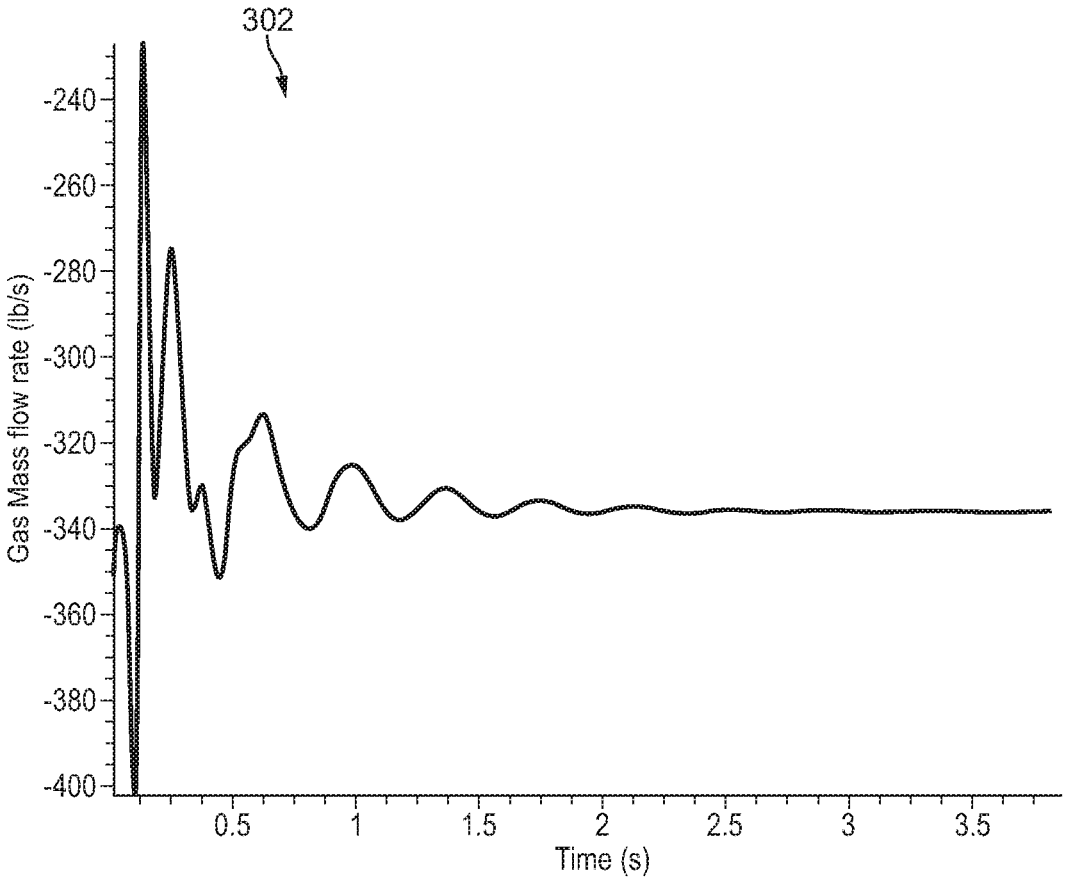
FIG. 10 is a graph illustrating a representative mass flow rate through the simulated target wellbore of FIG. 5.

At block 288 of method 200, the solutions obtained at block 286 are analyzed. In some embodiments, block 288 comprises numerically and visually (e.g., graphically) analyzed to understand the behavior of the fluid flows 256 and 264 of model 250. Referring to FIGS. 1-10, a graph 300 of a representative fluid velocity of blowout fluid flow 256 flowing through the inlet 252B of simulated target wellbore 250 is shown in FIG. 9 while a graph 302 of a representative mass flow rate of blowout fluid flow 256 flowing through inlet 252B is shown in FIG. 10 (shown as negative in FIG. 10 given that fluid flow 256 is directed towards the surface 10), where graphs 300 and 302 are produced by the method 280 of FIG. 6. Particularly, in the embodiment of FIGS. 1-10, graphs 300 and 302 illustrate fluid velocity and mass flow rate of blowout fluid flow 256 over time prior to the pumping of kill fluid flow 264 into simulated target wellbore 252 from simulated relief wellbore 260. Thus, graphs 300 and 302 indicate the initial conditions of simulated target wellbore 252 prior to the flowing of kill fluid flow 262 through simulated relief wellbore 260.

In the embodiment of FIG. 6, block 288 of method 200 comprises verifying graphs 300 and 302 of FIGS. 9 and 10 produced from the three-dimensional model 250 of FIG. 5 with the graphs 290 and 292 of FIGS. 7 and 8 produced by the one-dimensional model described above. Particularly, given that graphs 300 and 302 illustrate blowout fluid flow 256 prior to the pumping of kill fluid flow 264, the modeled data presented in graphs 300 and 302 may be compared with the data presented in FIGS. 7 and 8, which are also based on a fluid simulation that does not include a simulated kill fluid flow. For instance, graph 300 of FIG. 9, which indicates that the fluid velocity of blowout fluid flow 256 at interception point 270 is approximately 212 ft/s, corresponds to the fluid velocity indicated in graph 290 of FIG. 7 produced by the one-dimensional model. Additionally, graph 302 of FIG. 10, which indicates that the mass flow rate of blowout fluid flow 256 at interception point 270 is approximately equivalent to the mass flow rate indicated in FIG. 8 when the units of FIG. 8 (MMSCF/d) are converted to the units of FIG. 10 (lb/s) at the estimated conditions (e.g., temperature) of the interception point. While in this embodiment the initial conditions of simulated target wellbore 252 produced by the three-dimensional model 250 are verified using a one-dimensional fluid model, in other embodiments, the data produced by model 250 need not be verified by another model, such as a one-dimensional fluid model.

Referring to FIGS. 1-11, with the initial conditions of three-dimensional model 250 verified by the data produced by the one-dimensional model (comprising graphs 290 and 292 of FIGS. 7 and 8), model 250 may be employed via blocks 286 and 288 of the method 280 of FIG. 6 to analyze the response of blowout fluid flow 256 of simulated target wellbore 252 to various types of kill fluid flows 264 from simulated relief wellbore 260 at the interception point 270. Particularly, FIG. 11 includes a first output or visual simulation 310 from three-dimensional model 250 that illustrates fluid velocity of blowout fluid flow 256 and a kill fluid flow 264A at interception point 270, where, in the embodiment of FIG. 11, kill fluid flow 264A comprises a mud or hydrocarbon based fluid having a fluid density of approximately 11.5 pounds per gallon (ppg) and is pumped through simulated relief wellbore 260 at approximately 80 barrels per minute (bpm).

Figure 11:
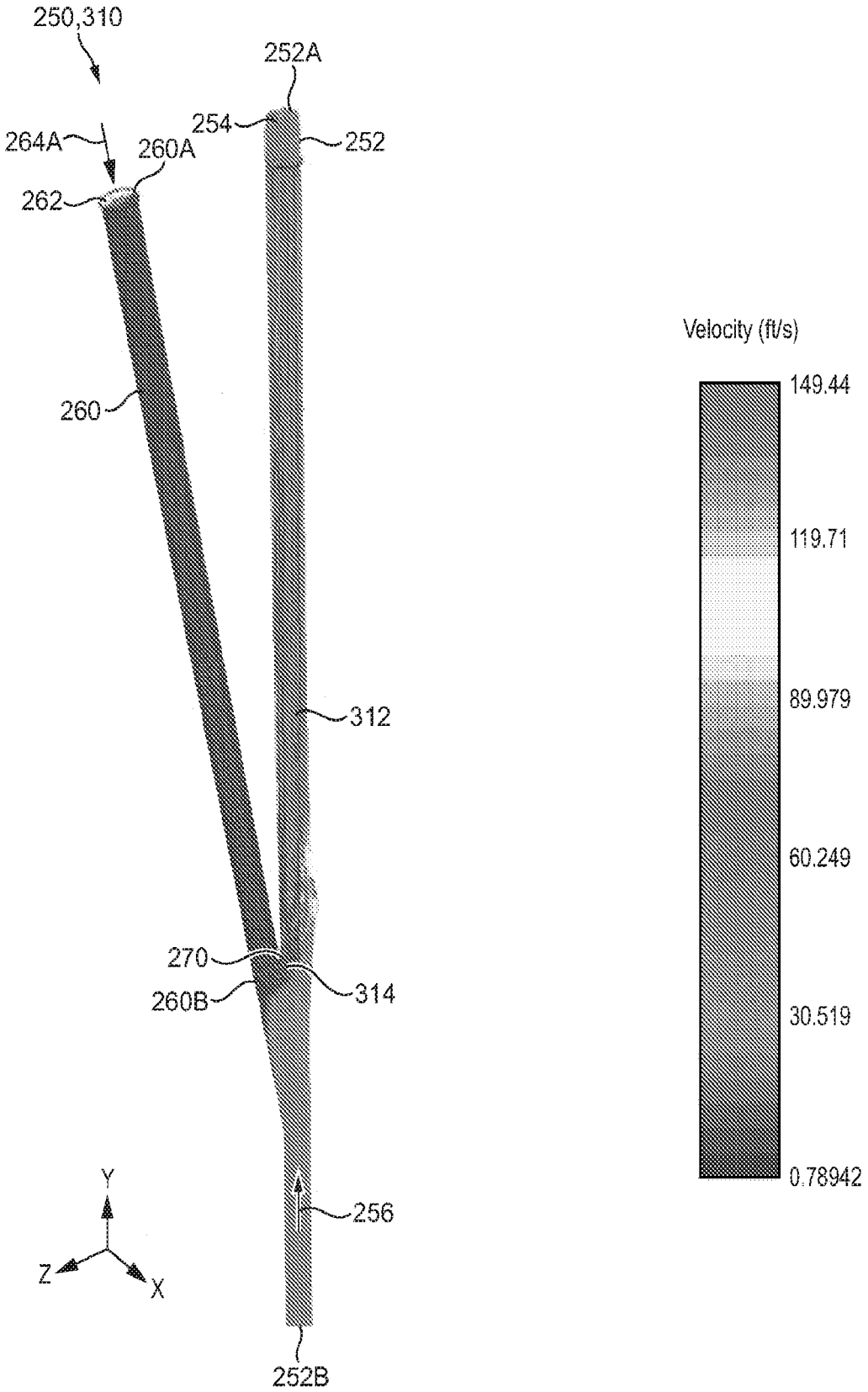
FIG. 11 is a side view of an embodiment of a first simulation produced using the model of FIG. 5 in accordance with principles disclosed herein.

In the embodiment of FIG. 11, first simulation 310 illustrates three-dimensional velocity and force vectors or streamlines 312 of blowout fluid flow 256 and three-dimensional velocity and force vectors or streamlines 314 of kill fluid flow 264A of model 250, including the three-dimensional interactions between vectors 312 and 314 (e.g., changes in momentum, density, mass, velocity, etc., of vectors 312 and 314). The magnitude in ft/s of the vectors 312 and 314 are indicated in the key presented in FIG. 11.

First simulation 310 thus illustrates the three-dimensional vector effects, such as changes in momentum, density, mass, velocity, etc., changes in three-dimensional direction of the vectors, etc., that accrue when kill fluid flow 264A collides with blowout fluid flow 256, where kill fluid flow 264A generally flows in a direction disposed at an angle (e.g., the intercept angle $\alpha$) relative to the general direction of blowout fluid flow 256. Thus, the first simulation 310 of FIG. 11 represents an embodiment of block 288 of method 280 that includes a graphical or visual analysis of the output or data provided by three-dimensional model 250. In other embodiments of method 200, the data presented by first simulation 310 may be analyzed numerically rather than graphically. As shown by the first simulation 310 of FIG. 11, kill fluid flow 264A is insufficient to cease blowout fluid flow 256, with blowout fluid flow 256 continuing to travel upwards through simulated target wellbore 250, exiting the outlet of wellbore 250 at approximately 60 ft/s in the embodiment of FIG. 11. Thus, first simulation 310 of model 250 indicates that kill fluid flow 264A flowing through simulated wellbore 260 is insufficient to kill or stabilize simulated target wellbore 252.

Figure 12A:
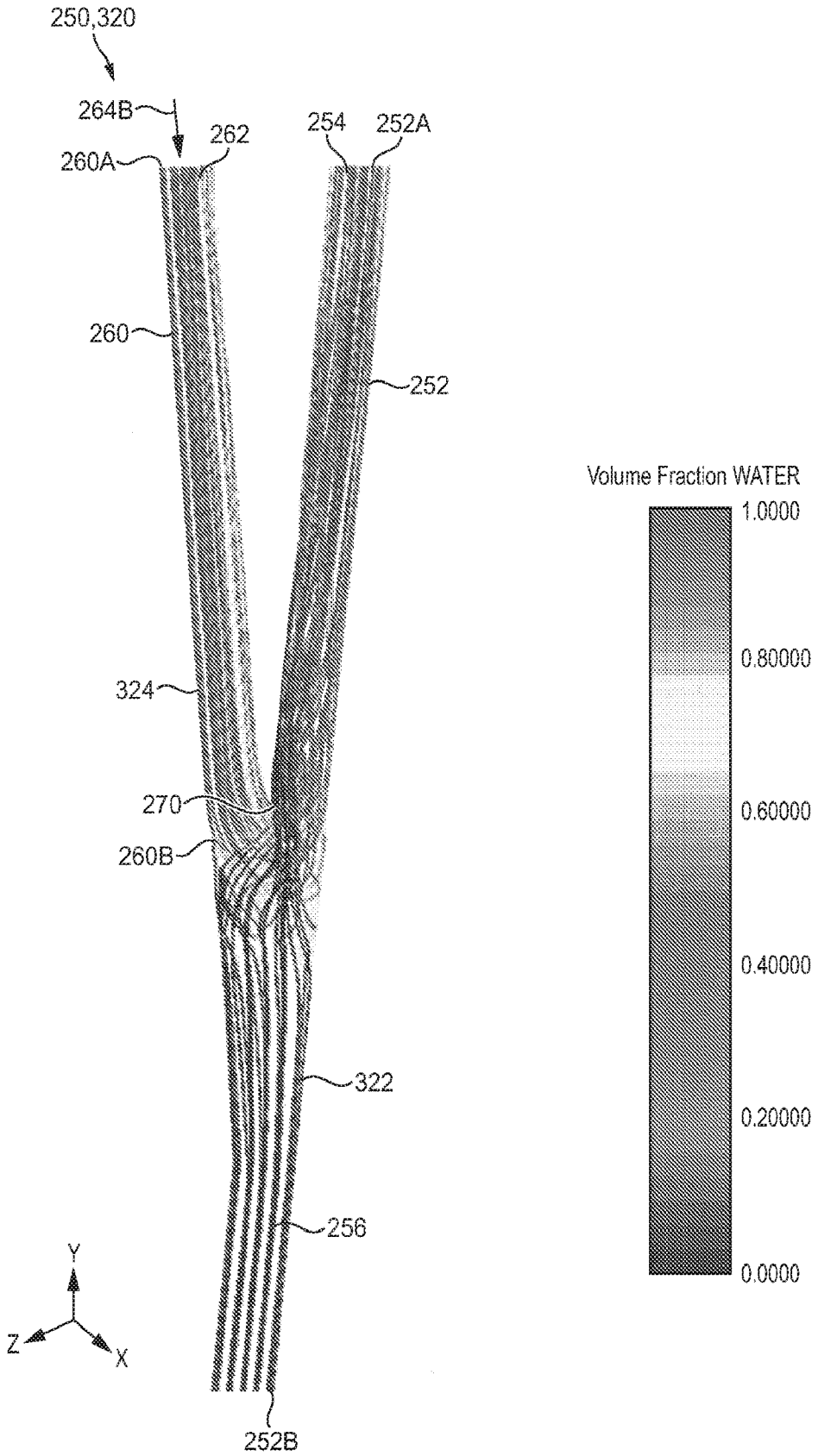
FIG. 12A is a side view of an embodiment of a second simulation at a first point in time during the simulation, the second simulation produced using the model of FIG. 5 in accordance with principles disclosed herein.
Figure 12B:
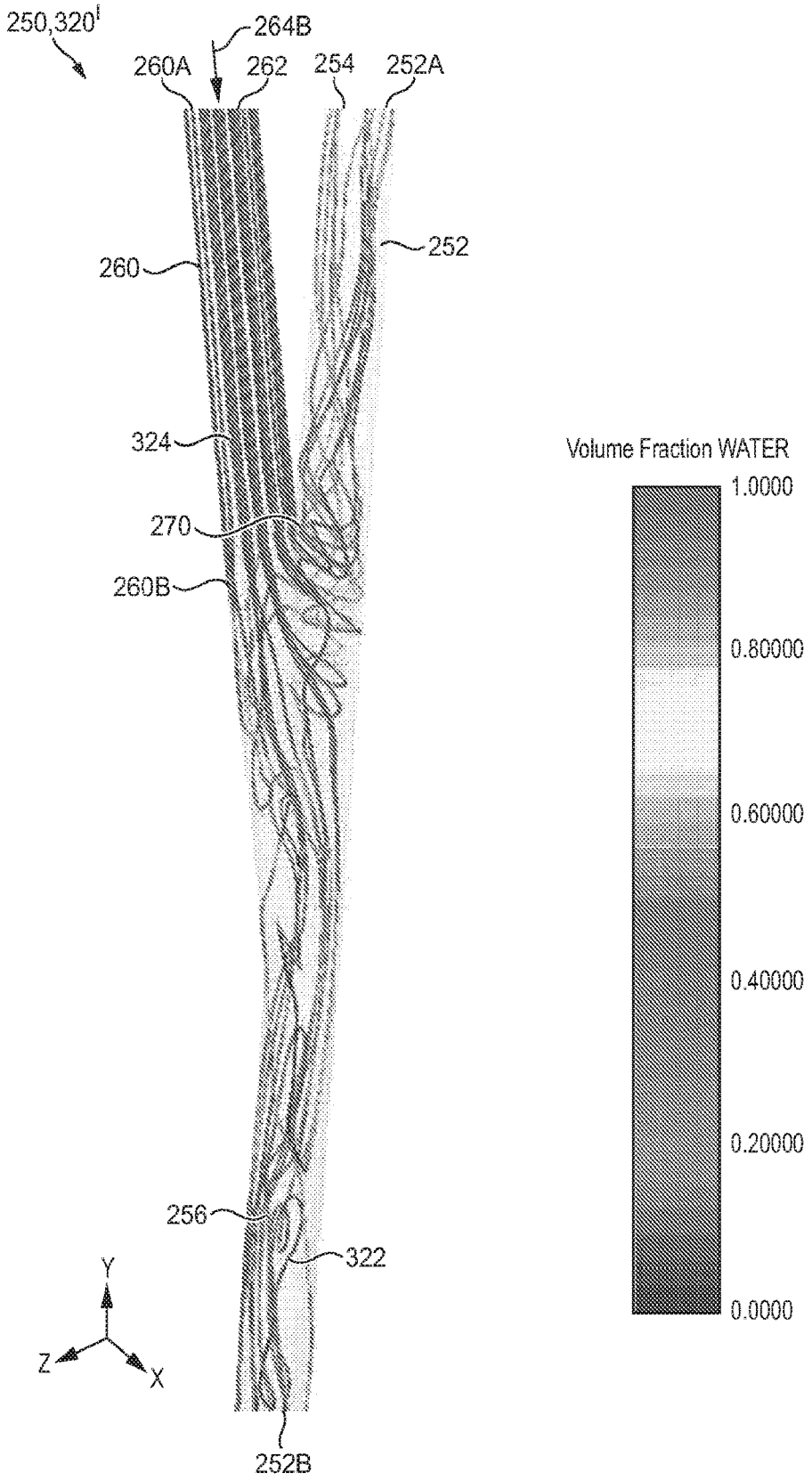
FIG. 12B is a side view of the second simulation of FIG. 12A at a second point in time during the simulation.

Referring to FIGS. 1-6, 12A, and 12B, FIGS. 12A and 12B each include a second visual output or simulation 320 (shown as simulation 320 in FIG. 12A and simulation 320' in FIG. 12B) from three-dimensional model 250 that illustrates the water volume fraction of blowout fluid flow 256 and the water volume fraction of a kill fluid flow 264B at interception point 270. The fluid flows 256 and 264B of the second simulation 320 represent water volume fraction (indicated by the keys presented in FIGS. 12A, 12B). Particularly, FIG. 12A illustrates simulation 320 at a first point in time during the simulation performed by model 250 while FIG. 12B simulation 320' at a second point in during the same simulation that is later in time or follows the first point in time shown in simulation 320. Thus, simulations 320 and 320' of FIGS. 12A and 12B illustrate the dynamic response of model 250 following the pumping or flowing of kill fluid flow 264B into simulated target wellbore 252 via interception point 270.

In the embodiment of FIGS. 12A and 12B, kill fluid flow 264B comprises a mud or hydrocarbon based fluid having a fluid density of approximately 16.0 pounds per gallon (ppg) and is pumped through simulated relief wellbore 260 at approximately 80 barrels per minute (bpm). Thus, the kill fluid flow 264B of second simulation 320 comprises a higher density than the kill fluid flow 264A of first simulation 310 (16.0 ppg versus 11.5 ppg) but the same volumetric flow rate as kill fluid flow 264A (80 bpm). Second simulations 320 and 320' of FIGS. 12A and 12B each illustrate three-dimensional velocity and force vectors or streamlines 322 of blowout fluid flow 256 and three-dimensional velocity and force vectors or streamlines 324 (including magnitude of fluid velocity of vectors 312 and 314 in ft/s) of kill fluid flow 264B of model 250, including the three-dimensional interactions between vectors 322 and 324 (e.g., changes in momentum, density, mass, velocity, etc., of vectors 322 and 324).

As shown particularly in FIG. 12A, second simulation 320 indicates that at the initiation of the pumping or flowing of kill fluid flow 264B into simulated target wellbore 252 via interception point 270, blowout fluid flow 256 continues to flow upwards through simulated target wellbore 252. Particularly, second simulation 320 illustrates that the water volume fraction of blowout fluid flow 256 remains relatively low (e.g., 0.3) as blowout fluid flow 256 flows through the outlet 252A of simulated target wellbore 252. Given that the blowout fluid flow 256 entering inlet 252A of simulated target wellbore 252 is almost entirely gaseous due to the gaseous composition of subterranean formation 12, the limited degree of water volume in the blowout fluid flow 256 entering inlet 252B and exiting outlet 252A indicates that kill fluid flow 264B is being forced upwards through outlet 252A along with blowout fluid flow 256. In other words, second simulation 320 of FIG. 12A indicates that the kill fluid flow 264B flowing into simulated target wellbore 252 has yet to kill or cease the upwards flow of blowout fluid flow 256 at the first point time. Thus, second simulation 320 represents an alternative graphical or visual mode for interpreting the results of the simulation performed by model 250 relative to first simulation 310 shown in FIG. 11 (e.g., water volume fraction versus fluid velocity).

As shown particularly in FIG. 12B, second interpretation 320' indicates that at the second point in time, which follows the first point in time shown in simulation 320, the water volume fraction of blowout fluid flow 256 has substantially increased relative to the water volume fraction at the first point in time. Particularly, the portion of blowout fluid flow 256 extending between interception point 270 and outlet 252A of simulated target wellbore 252 at the second point in time has a water volume fraction of generally between 0.6-1.0, indicating that blowout fluid flow 256 has largely or entirely ceased flowing upwards through outlet 252A of simulated target wellbore 252. Additionally, the portion of blowout fluid flow 256 extending between interception point 270 and inlet 252B of simulated target wellbore 252 at the second point in time has a water volume fraction of generally between 0.2-0.6, indicating that at least a portion of kill fluid flow 264B has begun to descend through simulated target wellbore 252 towards inlet 252B. In other words, the second simulation 320' indicates that kill fluid flow 264B at the second point in time has substantially or entirely ceased the upward flow of blowout fluid flow 256 through simulated target wellbore 252, indicating in-turn that a relief wellbore (e.g., relief wellbore 150) based on or constructed in view of or accordance with simulated relief wellbore 260 and flowing a kill fluid flow (e.g., kill fluid flow kill fluid 188) similar in density and flow rate as kill fluid flow 264B is sufficient to stabilize the target wellbore (e.g., target wellbore 102) by preventing an influx (e.g., influx 122) from entering the target wellbore.

Figure 13C:
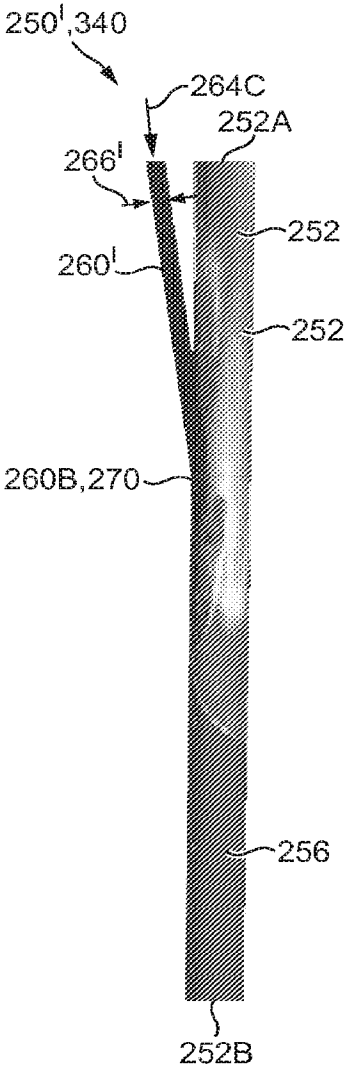
FIGS. 13A-13F are side views of an embodiment of a third simulation at discrete points in time during the simulation, the third simulation produced using the model of FIG. 5 in accordance with principles disclosed herein.
Figure 13B:
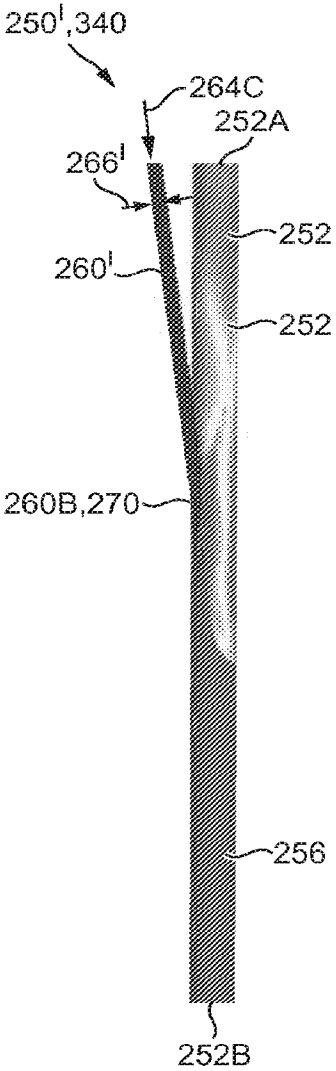
Figure 13A:
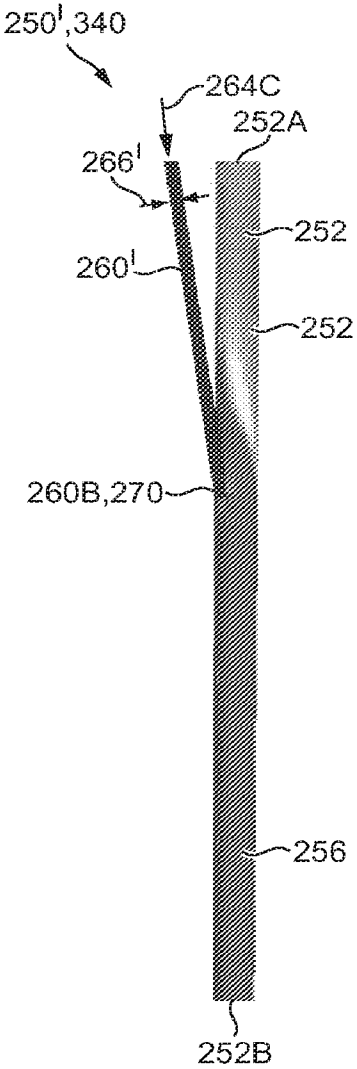
Figure 13F:
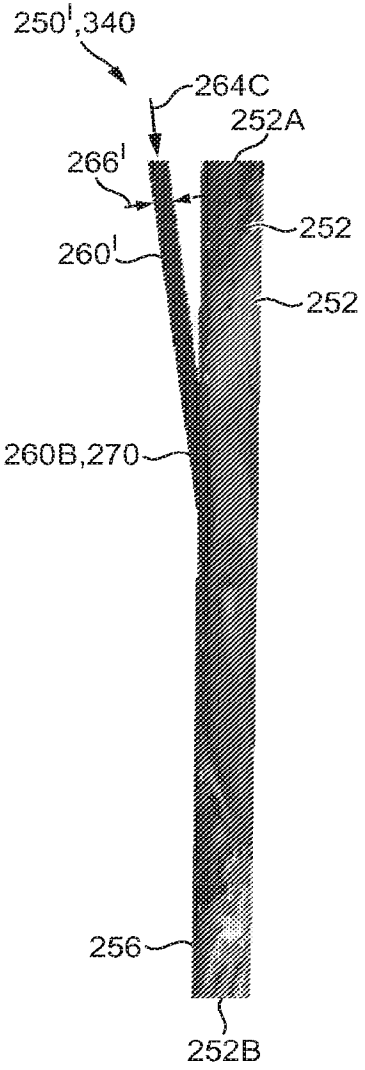
Figure 13E:
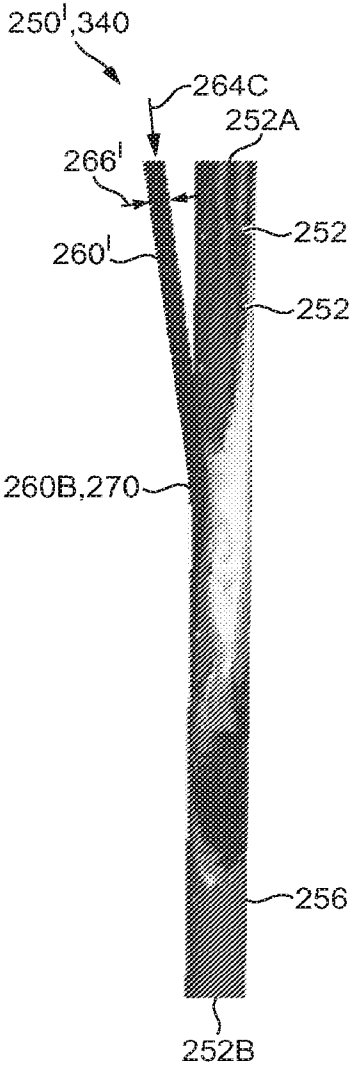
Figure 13D:
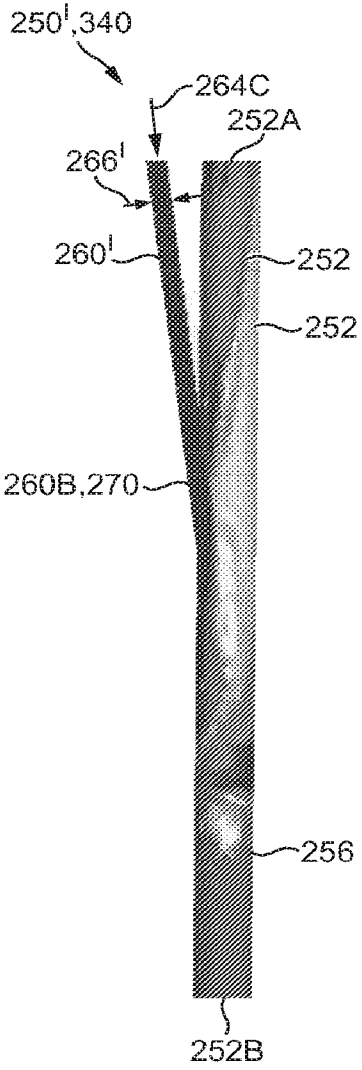

Model 250 of FIG. 5, while also allowing for the selective configuration of kill fluid flow 264 to identify fluid properties of flow 264 sufficient to stabilize simulated target wellbore 252, also allows for the selective configuration or adjustment of geometries of simulated relief wellbore 260 to identify geometries of wellbore 260 sufficient to stabilize simulated target wellbore 252 while maintaining the same characteristics of kill fluid flow 264 (e.g., flow rate, density, etc.). Referring to FIGS. 1-6 and 13A-13F, FIGS. 13A-13F each include a third output or visual simulation 340 from a three-dimensional model 250' where model 250' is similar to model 250 of FIG. 5 but includes a simulated relief wellbore 260' instead of the simulated relief wellbore 260 of model 250. Additionally, similar to the arrangement of FIGS. 12A and 12B, each FIG. 13A-13F illustrates third simulation 340 at a different point in time, with FIG. 13A illustrating simulation 340 at a first point in time at the initiation of the pumping or flowing of a kill fluid flow 264C into simulated target wellbore 252, with each succeeding FIG. 13B-13F illustrating third simulation 340 at a later point in time of the simulation 340.

In the embodiment of FIGS. 13A-13F, simulated relief wellbore 260' is similar in geometry and configuration as wellbore 260 except that wellbore 260' includes an inner diameter 266' that is less than the inner diameter 266 of wellbore 260. In the embodiment of FIGS. 13A-13F, diameter 266' is approximately 4"; however, in other embodiments, diameter 266', while being less than the diameter 266 of simulated relief wellbore 260', may vary substantially. Additionally, the density of the kill fluid comprising kill fluid flow 264C is the same as the kill fluid comprising the kill fluid flow 264A of first simulation 310 (11.5 ppg). However, given that the diameter 266' of simulated relief wellbore 260 is less than the diameter 266 of simulated relief wellbore 260, the fluid velocity of kill fluid flow 264C will exceed or be greater than the fluid velocity of kill fluid flow 264A at a given volumetric or mass flow rate. In other words, given the reduced diameter 266' of simulated relief wellbore 260' relative wellbore 260, the fluid velocity of kill fluid flow 264C of third simulation 340 must be greater to transport the same volume or mass of kill fluid as the kill fluid flow 264A over a given period of time. Thus, the reduced diameter 266' provides a jetting or increased velocity effect to the kill fluid flow 264C, with the kill fluid flow 264A of first simulation 310 flowing at a first fluid velocity while the kill fluid flow 264C of third simulation 340 flows at a second fluid velocity that is greater than the first fluid velocity. Thus, the second fluid velocity comprises a first increased fluid velocity. Similarly, a second increased fluid velocity different from the first increased fluid velocity may also be simulated using model 250.

The fluid flows 256, 264C of the third simulation 340 of FIGS. 13A-13F represent water volume fraction (the degree of water volume fraction indicated by the keys presented in FIGS. 12A, 12B). Third simulation 340 at the first point in time shown in FIG. 13A indicates an almost exclusively gaseous flow of blowout fluid flow 256 extending between the inlet 252B of simulated target wellbore 252 and interception point 270, indicating that at the first point in time blowout fluid flow 256 continues to flow upwards through simulated target wellbore 252 towards outlet 252A. However, moving sequentially through FIGS. 13A-13F, the water volume fraction in the portion of blowout fluid flow 256 continues to increase. Particularly, as shown in the last point in time of third simulation 340 in FIG. 13F, the water volume fraction of the portion of blowout fluid flow 256 extending between inlet 252B and interception point 270 is generally proximate 1.0, indicating that the kill fluid flow 264 from simulated relief wellbore 260' has begun to flow downwards through simulated target wellbore 252 towards inlet 252B. The downward flow of kill fluid flow 264C indicates in-turn that blowout fluid flow 256 has substantially declined or ceased, and simulated target wellbore 252 has been killed or stabilized.

Thus, although the kill fluid flow 264A of first simulation 310, which comprises a kill fluid having the same density and is pumped at the same volumetric flow rate as kill fluid flow 264C, is unable to kill or stabilize simulated target wellbore 252, the reduced diameter 266' of simulated relief wellbore 260' and the jetting or increased velocity effect produced thereby allows for the relatively light 11.5 ppg fluid to stabilize simulated target wellbore 252. Particularly, the increased velocity of kill fluid flow 264C also comprises an increased momentum relative flow 264A, causing the kill fluid comprising flow 264C to impart or affect a relatively greater change in momentum in the blowout fluid flow 256 of simulated target wellbore 252 relative to the flow 264A.

Referring to FIGS. 1-6 and 14, FIG. 14 illustrates a graph 350 comparing representative mass flow rates of the blowout fluid flow 256 of simulations 310, 320, 340, once kill fluid flows 264A, 264B, 264C, respectively, have begun flowing into simulated target wellbore 252 through interception point 270. As shown by graph 350, kill fluid flows 264B and 264C each kill or stabilize simulated target wellbore 252 by eventually reducing the mass flow rate of blowout fluid flow 256 to zero. Thus, graph 350 indicates that a relief wellbore constructed in accordance with or corresponding to the simulated relief wellbores 260 and 260' of simulations 320 and 340, respectively, and operated with relief or kill fluid flows having fluid parameters (e.g., fluid density, flow rate, fluid velocity, etc.) corresponding to the fluid parameters of kill fluid flows 264B and 264C should stabilize target wellbore 102 by ceasing the influx 182 into wellbore 102 from the surrounding formation 12.

Figure 14:
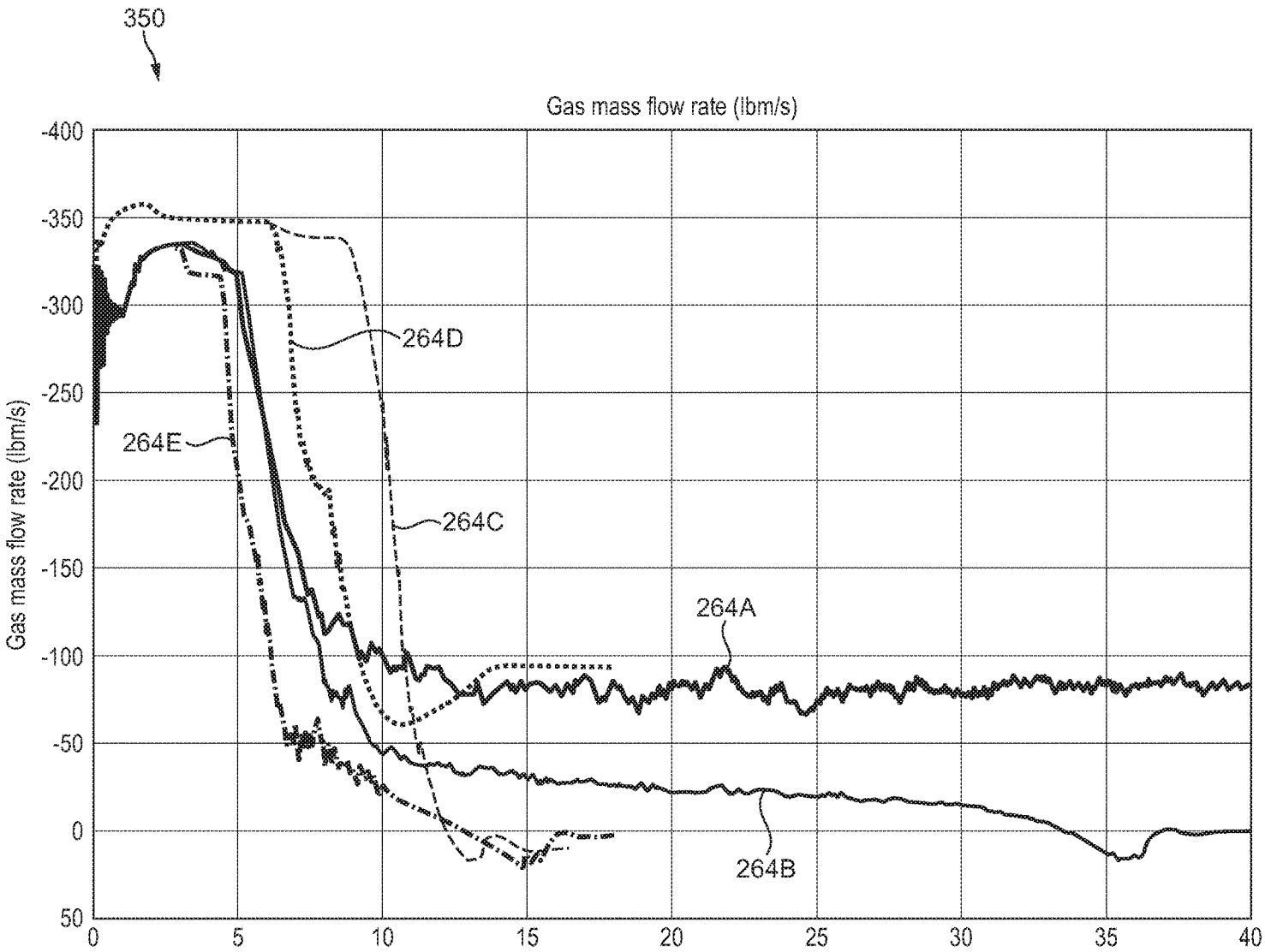
FIG. 14 is a graph illustrating a representative mass flow rates of embodiments of kill fluid flows of the simulated relief wellbore of FIG. 5 in accordance with principles disclosed herein.

Additionally, the graph 350 of FIG. 14 illustrates additional kill fluid flows 264D and 264E of additional simulations performed using three-dimensional model 250. Particularly, kill fluid flow 264D comprises 11.5 ppg fluid (e.g., water based mud, etc.) flowing at 50 bpm that is jetted at the second fluid velocity (e.g., via the reduced diameter 266' of simulated relief wellbore 260') while kill fluid flow 264E comprises 19.0 ppg fluid (e.g., water based mud, etc.) flowing at 80 bpm. In this manner, kill fluid flows having various fluid parameters and simulated relief wellbores having various parameters or geometries may be compared to identify particular configurations of relief wellbore geometries and kill fluid flow parameters sufficient to stabilize a simulated target wellbore modeled on the target wellbore of the particular application.

In some applications, it may be more convenient to vary the fluid parameters of the kill fluid flow while in others it may be advantageous (or required) to use a particular geometry for the relief wellbore, and thus, the flexibility provided by graph 350 and model 250 allows a user thereof to tailor the design of the eventually constructed and operated relief wellbore to the particular application. For instance, in the embodiment of FIGS. 1-6 and 14, relief wellbore 150 includes open portion 168 proximal interception point 180, which is exposed to fluid pressure within central passage 170 of relief wellbore 150. Thus, in order to prevent fracturing of the formation 12 at openhole portion 168 of relief wellbore 150, pressure within openhole portion 168 may not exceed the fracture gradient of formation 12 at the TVD openhole portion 168 occupies. Given that generally pressure within openhole portion 168 increases in response to an increase in either fluid density or flow rate of kill fluid flow 188, in some applications, a jetting effect applied to kill fluid flow 188 may be used to stabilize target wellbore 102 without fracturing the formation 12.

In some embodiments, model 250 may be used to simulate changes in the location of interception point 270 along the length of simulated target wellbore 252 and the impact of said changes on the interaction between blowout fluid flow 256 and kill fluid flow 264. In such embodiments, interception point 270 may comprise an initial interception point corresponding to the location of the lowermost casing shoe (e.g., casing shoe 117 of lower casing string 114 of target wellbore 102), while the simulations facilitated by model 250 may provide for the selection of a final interception point that varies from initial interception point 270. The final interception point may be closer to the surface relative to initial interception point 270 to reduce the costs of constructing and operating the relief wellbore. For instance, due to the greater accuracy provided by the three-dimensional model 250 relative to the one-dimensional fluid model described above, model 250 may indicate that a final interception point nearer the surface may be used to successfully stabilize the simulated target wellbore 252 than what would otherwise be indicated by the reduced accuracy afforced by the one-dimensional model.

Figure 15:
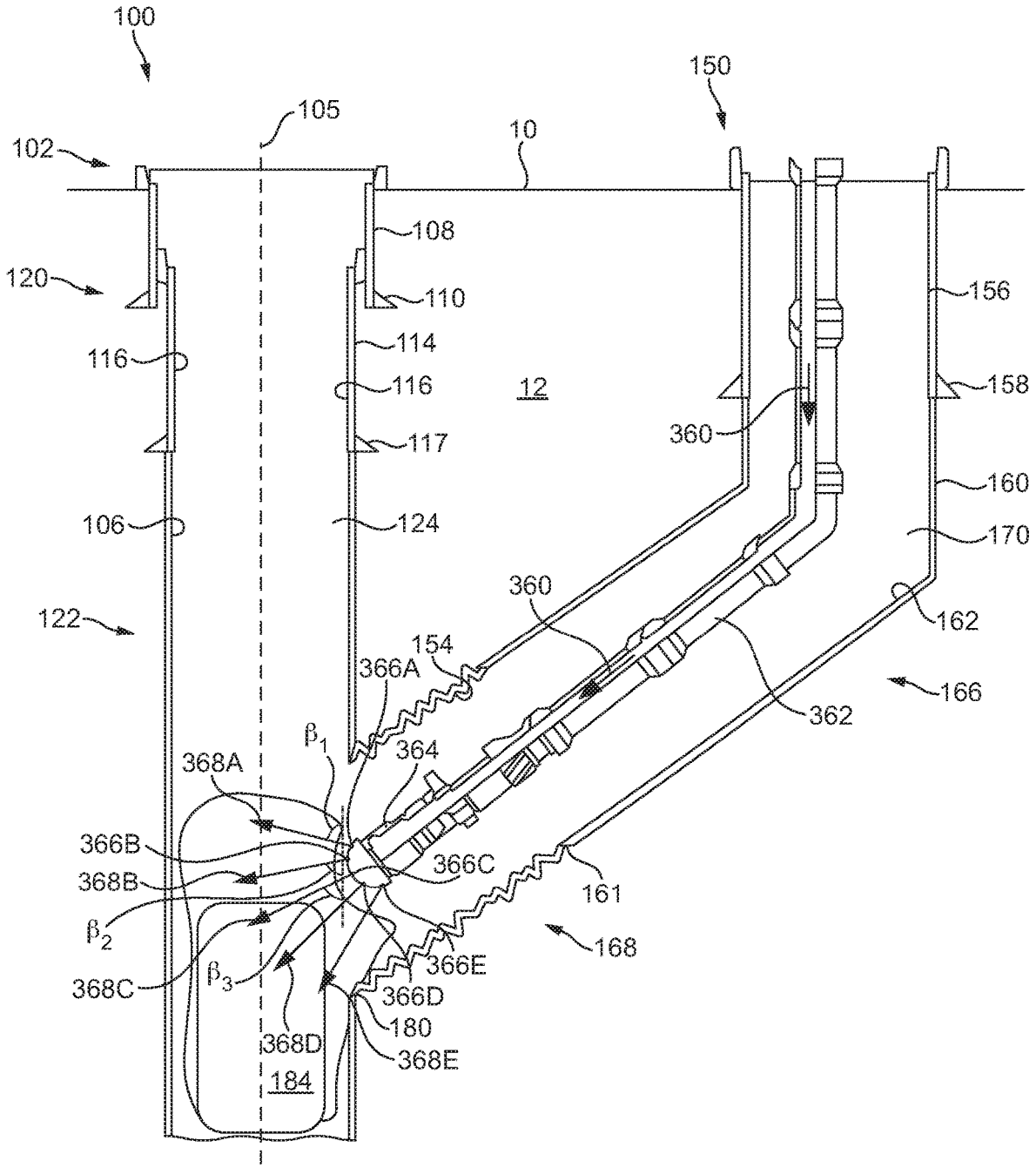
FIG. 15 is a schematic view of the well system of FIG. 1 including an embodiment of a tubular string in accordance with principles disclosed herein.

Referring to FIGS. 1-6, 12A, 12B, and 15, an alternative configuration for creating a jetting or increased velocity effect is shown in FIG. 15. In the embodiment of FIG. 15, instead of relying on central passage 170 of relief wellbore 150 as the fluid passage for flowing kill fluid flow 188, a kill fluid flow 360 is pumped through a tubular string or conduit 362 that extends through passage 170 of relief wellbore 150. Specifically, string 362 extends into relief wellbore 150 from the surface 10 to a lower end comprising a jetting tool 364. Jetting tool 364 comprises a plurality of nozzles or ports 366 (shown as ports 366A-366E in FIG. 15) to allow the kill fluid flow 360 to exit string 362 and flow into the central passage 124 of target wellbore 102.

In the embodiment of FIG. 15, string 362 comprises a drill string and jetting tool 364 comprises a drill bit having nozzles formed therein to allow for the passage or jetting of kill fluid flow 360 therethrough; however, in other embodiments, string 362 may comprise other tubular strings known in the art, such as coiled tubing, etc., and jetting tool 364 may comprise other tools to nozzle or increase a fluid velocity of a fluid flowing therethrough. Additionally, in the embodiment of FIG. 15, jetting tool 364 is positioned in the openhole portion 168 of relief wellbore 150 at interception point 180 and directly adjacent but spaced from central passage 124 of target wellbore 102; however, in other embodiments, jetting tool 364 may be positioned at least partially within passage 124 of target wellbore 102.

Conventional methods for killing a target wellbore using a relief wellbore in offshore applications may utilize choke and kill lines extending between a surface rig or platform and a BOP attached to a wellhead of the relief wellbore for conveying kill fluid to the relief wellbore from the surface rig. In at least some applications, the maximum permissible diameter of the choke and kill lines are limited. The limited size of the choke and kill lines increases the fluid velocity of kill fluid pumped therethrough, which may result in erosion of the choke and kill lines at high flow rates of the kill fluid and thereby limit the maximum permissible flow rate of the kill fluid supplied to the relief wellbore via the coke and kill lines.

Unlike the conventional method of utilizing choke and kill lines for supplying kill fluid to the relief wellbore, in the embodiment of FIG. 15 drill string 362 is utilized for supplying the kill fluid flow 360 from a surface rig or platform (not shown in FIG. 15). Thus, a successful kill may be obtained by pumping the kill fluid flow through drill string 362 while benefitting from the jetting effects determined, without jeopardizing the physical integrity of drill string 362 due to erosion from elevated fluid velocities of kill fluid flow 360.

In the embodiment of FIG. 15, nozzles 366A-366E can provide varying jetting angles in the fluid jets or nozzles 368A-386E of kill fluid flow 360 that extend from ports 366A-366E, respectively, where the jetting angles are measured respective a longitudinal axis 105 of target wellbore 102 at the interception point 180. For instance, nozzles 366A-366C are shown in FIG. 15 as providing jetting angles $\beta_1$-$\beta_3$, respectively, where jetting angles $\beta_1$-$\beta_3$ vary in degree relative to longitudinal axis 105 at interception point 180. Additionally, the jetting angle of nozzles 366A-366E may be positioned such that fluid nozzles extending therefrom are directed with or against the general direction of blowout fluid flow 184. For instance, in the embodiment of FIG. 15, jetting angle $\beta_1$ of port 366A is directed with blowout fluid flow 184 while jetting angles $\beta_2$ and $\beta_3$ of nozzles 366B and 366C are directed against blowout fluid flow 184. In some embodiments, jetting angles $\beta_1$-$\beta_3$ of the nozzles 366A-366E of jetting tool 364 may be manipulated or altered while jetting tool 364 is positioned in relief wellbore 150 by rotating string 362 from the surface rig from which it extends. Thus, jetting angles $\beta_1$-$\beta_3$ may be adjusted as desired without needing to remove string 362 from relief wellbore 150. Differences in the jetting angles of fluid nozzles 368A-386E alters the three-dimensional velocity and force vectors of fluid nozzles 368A-386E, in-turn affecting changes in the fluid properties and flow properties in the fluid comprising blowout fluid flow 184 and kill fluid flow 188. Thus, beyond altering the parameters of relief wellbore 150 and kill fluid flow 188, the amount of jetting effect (increased fluid velocity) and the jetting angle provided by nozzles 366A-366E may also be altered in order to facilitate the stabilization of target wellbore 102.

In some embodiments of model 250 of FIG. 5 and method 280 of FIG. 6, a jetting effect of a simulated jetting tool may be simulated using model 250. Additionally, in some embodiments, varying jetting angles provided by the simulated jetting tool may also be simulated using model 250 to illustrate changes in the velocity and force vectors of the kill fluid flow of the simulated relief wellbore (e.g., simulated relief wellbore 260), and how those changes in the velocity and force vectors impact the blowout fluid flow of the simulated target wellbore (e.g., simulated target wellbore 252). Thus, beyond the parameters of simulated relief wellbore 260 and kill fluid flow 264, parameters of a simulated jetting tool (e.g., jetting angle, diameters of the nozzles or jets of the jetting tool, etc.) may also be analyzed using model 250 in certain embodiments.

Figure 16:
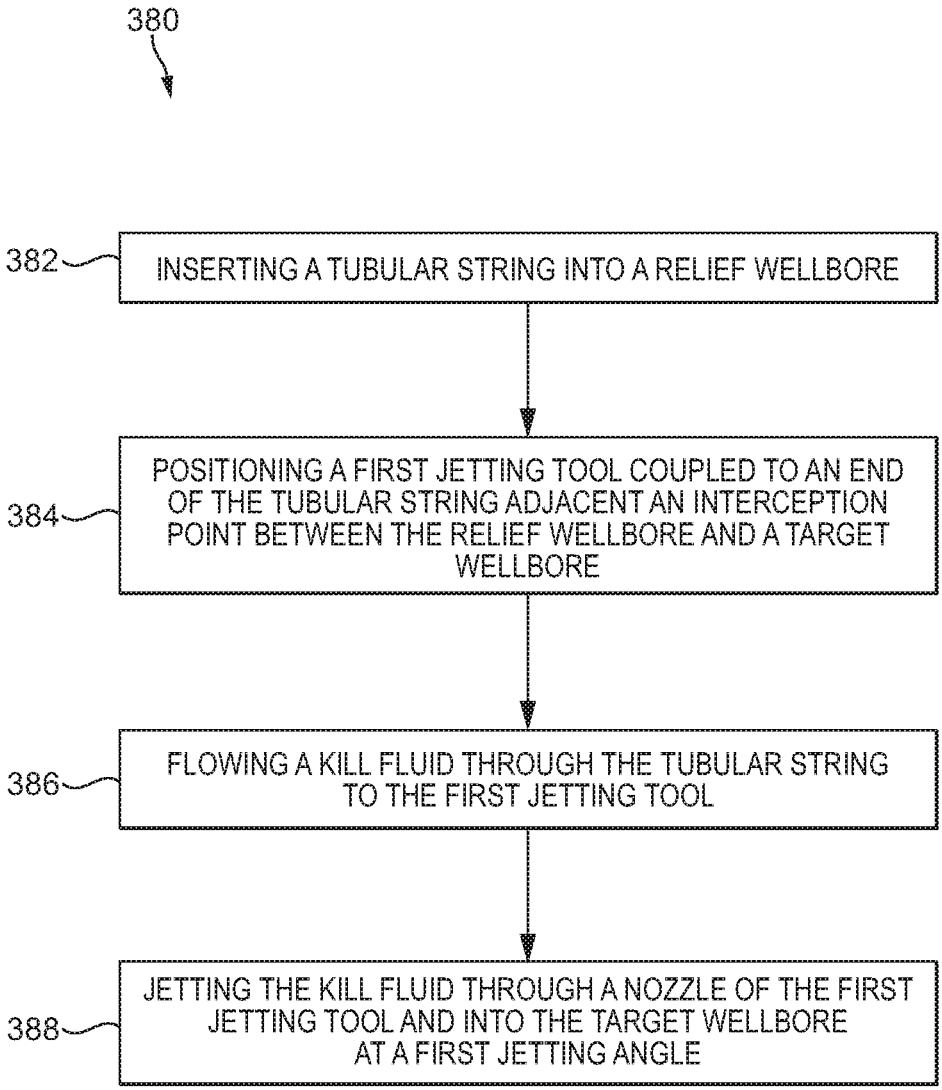
FIG. 16 is a flowchart illustrating an embodiment of a method for mitigating a fluid flow from a target wellbore using the relief wellbore of FIG. 15 in accordance with principles disclosed herein.

Referring now to FIGS. 15, 16, an embodiment of a method 380 for mitigating a fluid flow from a target wellbore using a relief wellbore, such as the relief wellbore 150 of FIG. 15, is shown in FIG. 16. At block 382 of method 380, a tubular string is inserted into a relief wellbore. In some embodiments, block 382 comprises inserting drill string 362 into relief wellbore 150. At block 384 of method 380, a first jetting tool coupled to an end of the tubular string is positioned adjacent an interception point between the relief wellbore and a target wellbore. In some embodiments, block 384 comprises positioning jetting tool 364 adjacent the intersection point 180 between relief wellbore 150 and target wellbore 102.

At block 386 of method 380, a kill fluid is flowed through the tubular string to the first jetting tool. In certain embodiments, block 386 comprises flowing the kill fluid flow 360 through drill string 362 to the jetting tool 364 coupled thereto. At block 388 of method 380, the kill fluid is jetted through a nozzle of the first jetting tool and into the target wellbore at a first jetting angle. In certain embodiments, block 388 comprises jetting the kill fluid flow 360 through the first nozzle 368A of jetting tool 364 at the first jetting angle $\beta_1$. In some embodiments, method 380 may additionally comprise rotating drill string 362 to provide a second jetting angle that is different from the first jetting angle $\beta_1$ when the kill fluid flow 360 is jetted through the first nozzle 368A of jetting tool 364. In some embodiments, method 380 may further comprise removing the jetting tool 364 from drill string 362 and replacing it with a second jetting tool having different flow characteristics than jetting tool 364. For example, the second jetting tool may include nozzles providing different flow restrictions or jetting angles than that provided by nozzles 368A-368C of jetting tool 364.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

To further illustrate various illustrative embodiments of the present invention, the following example is provided.

Example 1

Figure 17:
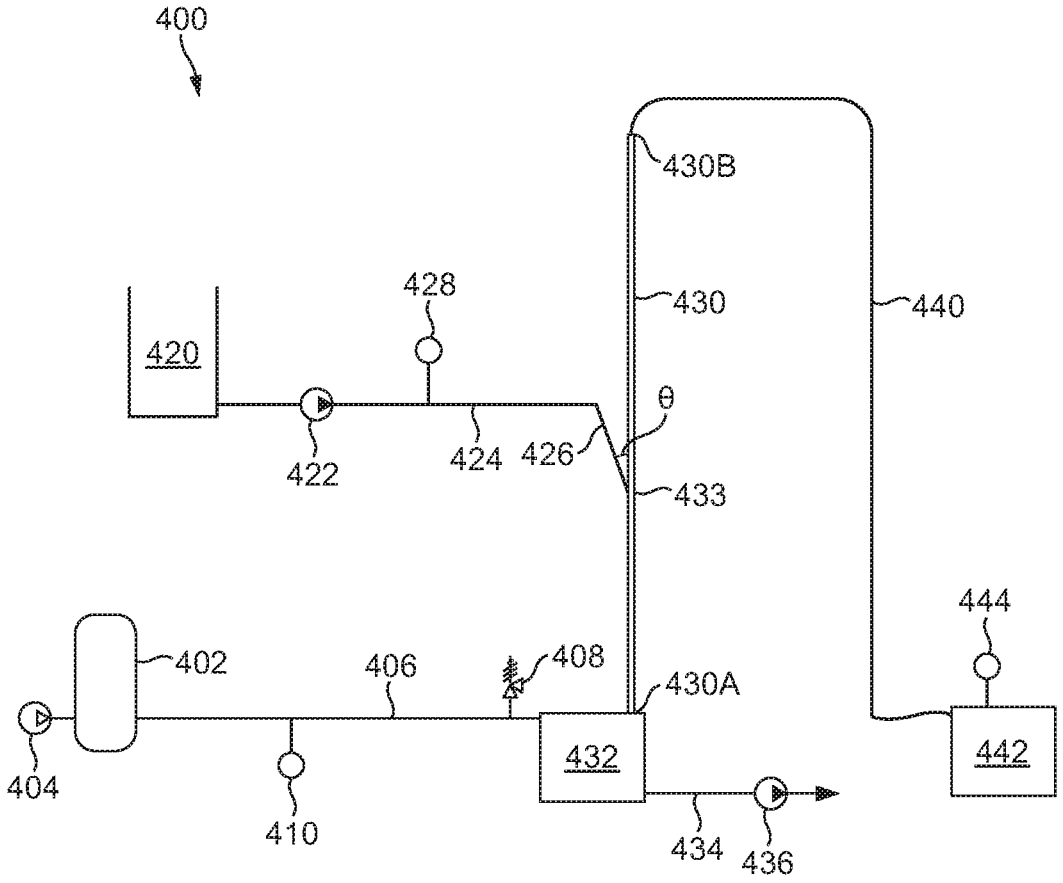
FIG. 17 is a schematic view of an embodiment of a test system in accordance with principles disclosed herein.
Figure 18:
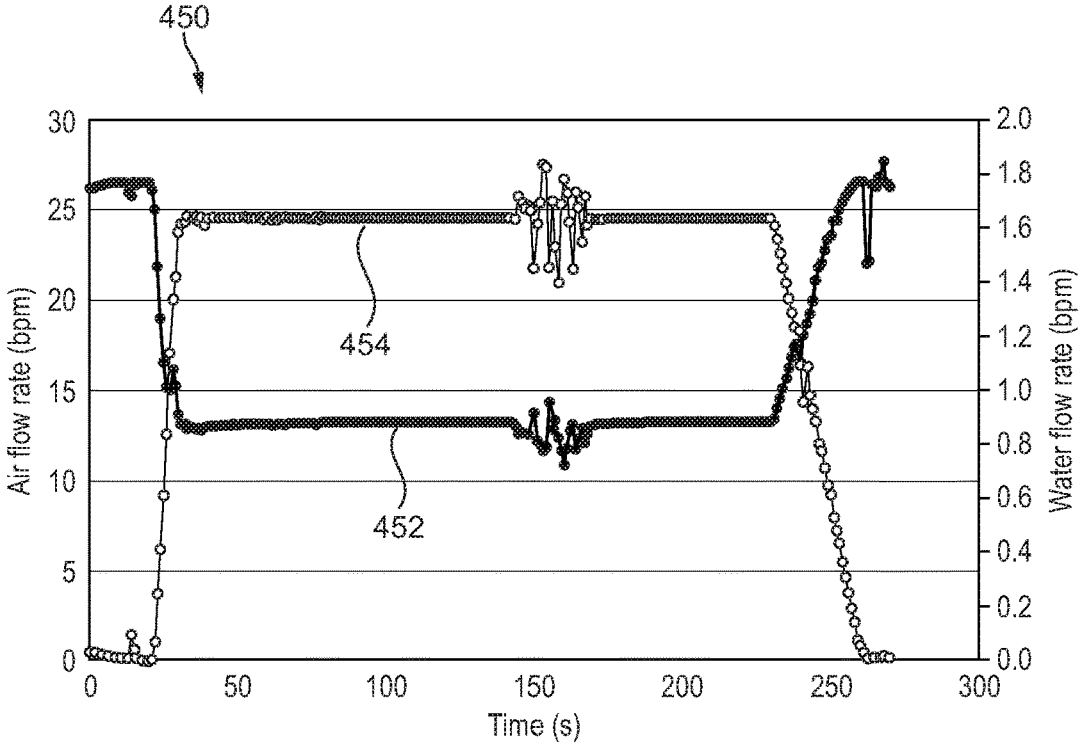
FIGS. 18, 19 are graphs illustrating estimated fluid flow rates of the test system of FIG. 17.
Figure 19:
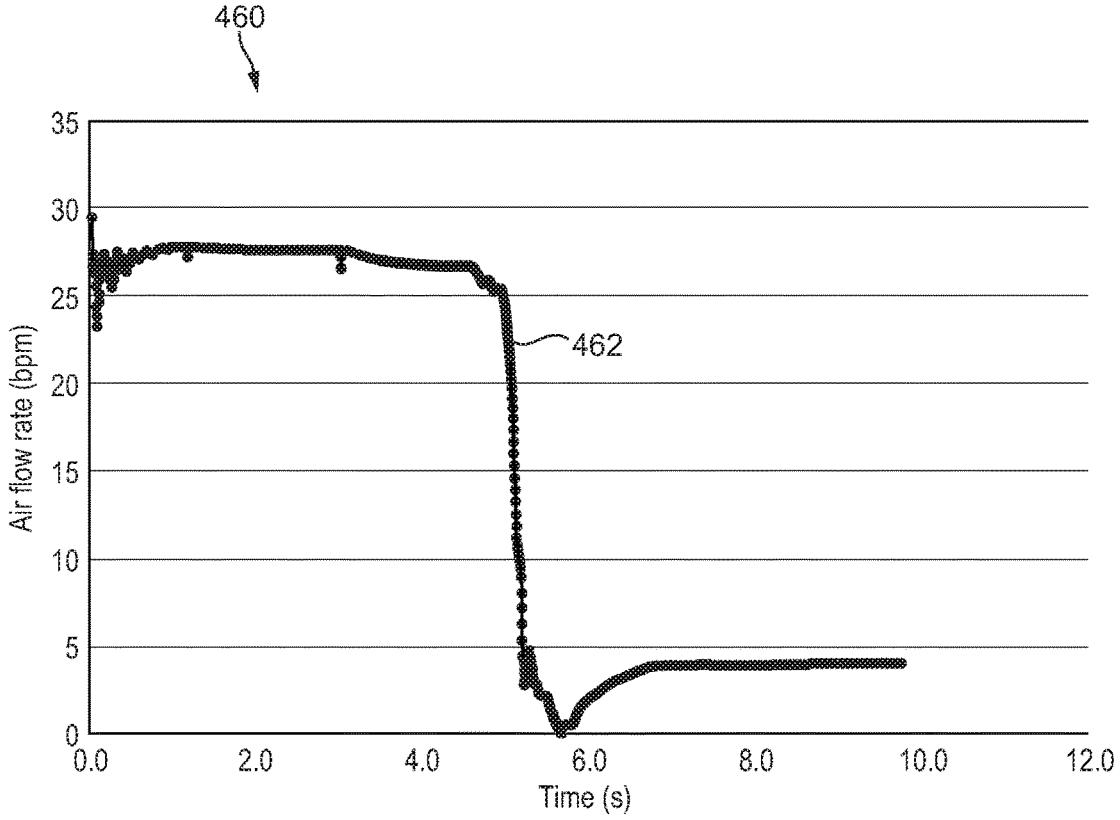

Referring to FIGS. 17-19, to verify the enhanced accuracy of the three-dimensional CFD models (e.g., three-dimensional CFD model 250) relative to the one-dimensional models described herein, a test system 400 was setup for simulating the killing of an uncontrolled fluid flow from a target wellbore using a relief wellbore. In the embodiment of FIGS. 17-19, the test system 400 that comprised a gas source or tank 402, a liquid source or tank 420, a substantially vertically extending fluid conduit 430, a flexible conduit or hose 440, and a settling tank 442. Particularly, gas tank 402 stored air pressurized by a compressor 404, the gas tank 402 in fluid communication with a gas conduit 406 extending between tank 402 and a reservoir 432 coupled to a first or lower end 430A of the vertical fluid conduit 430. Pressure in gas conduit 406 was regulated via a pressure regulator 408 while mass flow, pressure, and temperature readings of gas flowing through gas conduit 406 were measured by a gas sensor assembly 410.

The liquid tank 420 of test system 400 was connected to vertical fluid conduit 430 via a liquid conduit 424 extending therebetween. A pump 422 coupled to liquid conduit 424 was used to pump water stored in liquid tank 420 into vertical conduit 430 at an interception point 433. Mass flow, pressure, and temperature readings of water flowing through liquid conduit 424 were measured by a liquid sensor assembly 428 connected to liquid conduit 424. Additionally, liquid conduit 424 included an inclined portion 426 that intercepted vertical conduit 430 at a known intercept angle θ. In this embodiment, interception point 433 was disposed approximately 2.5 meters (m) from the lower end 430A of vertical fluid conduit 430. Vertical fluid conduit 430 included a second or upper end 430B coupled to hose 440, the upper end 430B of vertical fluid conduit 430 being positioned approximately 4.5 m from interception point 433.

Reservoir 432 of test system 400 was coupled between gas conduit 406 and the lower end 430A of the vertical fluid conduit 430, where reservoir 432 included a liquid outlet 434 for pumping liquid that had settled at the bottom of reservoir 432 via a pump 436 coupled to liquid outlet 434. Hose 440 of test system 440 extended between the upper end 430B of vertical fluid conduit 430 and settling tank 442, which was configured to receive multiphase fluid flowing from vertical fluid conduit 430, and included a sensor assembly 444 for measuring the flow rate of multiphase fluid supplied to reservoir 432 from vertical fluid conduit 430 and hose 440.

A one-dimensional model was used to estimate the reduction in gas (air in this instance) flow rate into vertical fluid conduit 430 at lower end 430A from an initial gas flow rate of approximately 26.5 barrels per minute (bpm) in response to the pumping of liquid (water in this instance) into vertical fluid conduit 430 at interception point 433 at a liquid flow rate of approximately 1.64 gpm. As shown in graph 450 FIG. 18, the one-dimensional model predicted the gas fluid flow 452 would decline by approximately 50% (from 26.5 bpm to approximately 13.3 bpm) in response to pumping the liquid flow 454 into the vertical fluid conduit 430 at approximately 1.64 gpm. Additionally, a three-dimensional CFD model (e.g., three-dimensional CFD model 250 shown in FIG. 5) was also used to estimate the reduction in gas flow rate into vertical fluid conduit 430 from an initial gas flow rate of approximately 26.5 bpm in response to the pumping of liquid into vertical fluid conduit 430 at a liquid flow rate of approximately 1.64 gpm. As shown in graph 460 of FIG. 19, the three-dimensional CFD model predicted the gas fluid flow 462 would decline by approximately 90% (from 26.5 bpm to approximately 2.7 bpm) in response to pumping liquid into the vertical fluid conduit 430 at approximately 1.64 gpm.

Following the estimations performed by the one-dimensional model (illustrated by graph 450 of FIG. 18) and the three-dimensional CFD model (illustrated by graph 460 of FIG. 19), air was first pumped into the lower end 430A of vertical fluid conduit 430 at approximately 26.5 bpm, and subsequently water was pumped into vertical fluid conduit 430 at interception point 433 at approximately 1.64 bpm.

TABLE 1

| | |
|---|---|
| Gas (Air) Flow (bpm) | 26.5 |
| Air mass flow (pounds/second) | .22 |
| Air velocity (feet/second) | 115 |
| Liquid (Water) Flow (bpm) | 1.64 |
| Kill fluid velocity (feet/second) | 6.9 |
| % Gas Flow Reduction | 98 |

As shown above in Table 1, which includes additional parameters of the exemplary test that was performed using test system 400, the actual reduction in air flow rate into vertical fluid conduit 430 in response to the pumping of water into vertical fluid conduit 430 at 1.64 bpm was 98%. Thus, the reduction in gas flow predicted by the three-dimensional CFD model (90%) was only 8% off of the actual reduction in gas flow measured by the sensor assembly 444 coupled to setting tank 442, whereas the reduction in gas flow predicted by the one-dimensional model (50%) underestimated the reduction in gas flow into vertical fluid conduit 430 by approximately 48%. Thus, the test performed using test system 400 confirmed that, in at least some applications, the three-dimensional CFD model (e.g., three-dimensional CFD model 250 shown in FIG. 5) was more accurate than the conventional one-dimensional model when predicting the reduction in fluid flow from a simulated target wellbore (e.g., the flow of air into the lower end 430A of vertical fluid conduit 430 from gas conduit 406) in response to the influx of a kill fluid flow from a simulated relief wellbore (e.g., the flow of water into vertical fluid conduit 430 from liquid conduit 424).

What is claimed is:

1. A method for mitigating a fluid flow from a target wellbore using a relief wellbore, comprising:
- receiving wellbore geometry information of the target wellbore;
- receiving an initial interception point of the target wellbore;
- simulating a change in a three-dimensional flow characteristic of a kill fluid flow from a simulated relief wellbore and a target fluid flow from a simulated target wellbore resulting from an interaction between the kill fluid flow and the target fluid flow at the initial interception point, the simulated target wellbore designed using the received wellbore geometry information; and
- determining a final interception point of the target wellbore based on the simulation.

2. The method of claim 1, further comprising drilling the relief wellbore to intercept the target wellbore at the final interception point.

3. The method of claim 2, further comprising:
- extending a tubular string through the relief wellbore; and
- pumping the kill fluid flow through the tubular string and into the target wellbore at the final interception point.

4. The method of claim 3, further comprising providing a first increased velocity of the kill fluid flow as the kill fluid flow exits the tubular string.

5. The method of claim 4, further comprising providing a second increased velocity of the kill fluid as the kill fluid exits the tubular string that is different from the first increased velocity.

6. The method of claim 2, further comprising pumping the kill fluid flow from the relief wellbore into and through the target wellbore to a location downhole of the final interception point.

7. The method of claim 1, further comprising determining at least one parameter of the kill fluid flow of the relief wellbore based on the simulation, wherein determining the at least one parameter of the kill fluid flow of the relief wellbore comprises determining at least one of a desired kill fluid flow rate and a desired kill fluid density of the kill fluid flow.

8. The method of claim 1, further comprising simulating three-dimensional vector effects of the kill fluid flow from the simulated relief wellbore at the initial interception point.

9. The method of claim 1, further comprising:
- receiving formation information pertaining to a subterranean formation through which the target wellbore extends, the formation information comprising a fracture gradient of the formation; and
- determining a desired kill fluid flow rate and a desired kill fluid density of the relief wellbore based on the simulation, the desired kill fluid flow rate and the desired kill fluid density configured to provide a pressure at the formation that does not exceed the fracture gradient of the formation at the final interception point.

10. The method of claim 1, further comprising determining an intercept angle between the relief wellbore and the target wellbore at the final interception point based on the simulation.

11. A method for mitigating a fluid flow from a target wellbore using a relief wellbore, comprising:
- receiving wellbore geometry information of the target wellbore;
- simulating three-dimensional vector effects of a kill fluid flow from a simulated relief wellbore into a simulated target wellbore, the simulated target wellbore designed using the received wellbore geometry information; and
- drilling the relief wellbore to intercept the target wellbore.

12. The method of claim 11, further comprising flowing a kill fluid flow from the relief wellbore into the target wellbore, wherein at least one of the fluid density and fluid flow rate of the kill fluid flow is selected using the simulated three-dimensional vector effects.

13. The method of claim 12, further comprising simulating a trajectory of the kill fluid flow as the kill fluid flow enters and flows through the target wellbore.

14. The method of claim 11, further comprising simulating a jetting effect applied to the kill fluid flow.

15. The method of claim 14, further comprising jetting the kill fluid flow from a nozzle disposed proximal a terminal end of the relief wellbore, a diameter of the nozzle selected using the simulated jetting effect.

16. The method of claim 15, further comprising simulating a first trajectory of the kill fluid flow as the kill fluid flow exits a simulated nozzle.

17. The method of claim 16, further comprising:
adjusting a jetting angle of the simulated nozzle; and
simulating a trajectory of the kill fluid flow as the relief flow exits the simulated nozzle.

18. The method of claim 11, further comprising simulating three-dimensional vector effects of a target fluid flow from a simulated target wellbore.

19. The method of claim 11, further comprising simulating a change in a three-dimensional flow characteristic of the kill fluid flow from the simulated relief wellbore and a target fluid flow from the simulated target wellbore resulting from an interaction between the kill fluid flow and the target fluid flow at the initial interception point.

20. The method of claim 11, further comprising:
receiving an initial interception point of the target wellbore; and
determining a final interception point of the target wellbore based on the simulation.

21. A well system, comprising:
a target wellbore comprising a target fluid flow; and
a relief wellbore that intercepts the target wellbore at a final interception point, the relief wellbore including a kill fluid flow configured to cease the target fluid flow;
wherein the relief wellbore is designed using a well simulation system executed by a computer system, the well simulation system configured to simulate three-dimensional vector effects of a simulated kill fluid flow from a simulated relief wellbore into a simulated target wellbore.

22. The well system of claim 21, wherein the well simulation system comprises:
a processor; and
a memory coupled to the processor, the memory encoded with instructions that are executable by the computer to
receive wellbore geometry information of the target wellbore; and
generate one or more parameters of the relief wellbore, the relief wellbore parameters comprising at least one of the interception point of the relief wellbore in true vertical depth, a fluid density of the kill fluid flow, and a fluid flow rate of the kill fluid flow.

23. The well system of claim 22, wherein the memory of the well simulation system is encoded with instructions that are executable by the computer to simulate a change in a three-dimensional flow characteristic of the simulated kill fluid flow and a simulated target fluid flow from the simulated target wellbore resulting from an interaction between the simulated kill fluid flow and the simulated target fluid flow at the interception point of the simulated relief and target wellbores.

24. The well system of claim 22, wherein the memory of the well simulation system is encoded with instructions that are executable by the computer to generate one or more parameters of a tubular string insertable into the relief wellbore, the tubular string parameters comprising a diameter of a nozzle of the tubular string.

25. The well system of claim 21, wherein the three-dimensional vector effects simulated by the well simulation system comprise at least one of simulated three-dimensional force and velocity vectors.

26. A method for mitigating a target fluid flow from a target wellbore using a relief wellbore, comprising:
inserting a tubular string into the relief wellbore;
positioning a first jetting tool coupled to an end of the tubular string adjacent an interception point between the relief wellbore and the target wellbore, wherein the target fluid flow travels uphole through the target wellbore and past the interception point;
flowing a kill fluid through the tubular string to the first jetting tool; and
jetting the kill fluid through a nozzle of the first jetting tool and into the target wellbore at a first jetting angle to cease the uphole travel of the target fluid flow past the interception point.

27. The method of claim 26, further comprising:
rotating the tubular string in the relief wellbore; and
jetting the kill fluid through the nozzle of the first jetting tool and into the target wellbore at a second jetting angle that is different from the first jetting angle.

28. The method of claim 26, further comprising:
coupling a second jetting tool to the tubular string including a nozzle configured to provide a second jetting angle that is different from the first jetting angle; and
jetting the kill fluid through the nozzle of the second jetting tool and into the target wellbore at the second jetting angle.

29. The method of claim 26, wherein the nozzle of the first jetting tool includes a first flow restriction configured to increase the velocity of the kill fluid as it is jetted through the nozzle of the first jetting tool.

30. The method of claim 29, further comprising:
coupling a second jetting tool to the tubular string including a nozzle having a second flow restriction that is greater than the first flow restriction of the first jetting tool; and
jetting the kill fluid through the nozzle of the second jetting tool and into the target wellbore.

* * * * *